US005361582A

United States Patent [19]

Uchida et al.

[11] Patent Number: 5,361,582

[45] Date of Patent: Nov. 8, 1994

[54] DUAL SENSOR TYPE AIR FUEL RATIO CONTROL SYSTEM FOR INTERNAL COMBUSTION ENGINE

[75] Inventors: Masaaki Uchida; Mikio Matsumoto, both of Yokosuka, Japan

[73] Assignee: Nissan Motor Co., Ltd., Yokohama, Japan

[21] Appl. No.: 81,223

[22] Filed: Jun. 25, 1993

Related U.S. Application Data

[62] Division of Ser. No. 645,975, Jan. 23, 1991.

[30] Foreign Application Priority Data

Jan. 24, 1990 [JP] Japan ..... 2-14632
Jan. 25, 1990 [JP] Japan ..... 2-13566
Mar. 7, 1990 [JP] Japan ..... 2-55826

[51] Int. Cl.[5] ..... F01N 3/20

[52] U.S. Cl. ..... 60/276; 60/285; 123/674; 123/691

[58] Field of Search ..... 60/274, 276, 285; 123/674, 691

[56] References Cited

U.S. PATENT DOCUMENTS 3,939,654 2/1976 Creps ..... 60/276
4,235,204 11/1980 Rice .
4,707,985 11/1987 Nagai et al. ..... 60/274
4,723,408 2/1988 Nagai et al. ..... 60/274
4,761,950 8/1988 Nagai et al. ..... 60/274
4,779,414 10/2988 Nagai et al. ..... 60/274
4,796,425 1/1989 Nagai et al. ..... 60/274
4,831,838 5/1989 Nagai et al. ..... 60/274
4,901,240 2/1990 Schmidt et al. ..... 364/431.06
4,913,122 4/1990 Uchida et al. .
5,025,767 6/1991 Kume et al. .
5,117,631 6/1992 Moser ..... 60/274

FOREIGN PATENT DOCUMENTS 0292175 11/1988 European Pat. Off. .
58-72647 4/1983 Japan .
63-176643 7/1988 Japan .
1-113552 5/1989 Japan .
1-262340 10/1989 Japan .

*Primary Examiner*—Douglas Hart
*Attorney, Agent, or Firm*—Foley & Lardner

[57] ABSTRACT

A learning or updating function which corrects the feedback control correction factor Œ is included in a dual $O_2$ sensor type control system. Correction related data which is used to modify Œ in response to the output of an upstream sensor or sensor section, is recorded at memory addresses which corresponding to the subsections of an engine operation map. When the output of the upstream sensor changes, a sub-region in which the engine operation fell a time $\tau$ earlier or in which the engine operation has continuously fallen for the time $\tau$, is selected and the correction related data which is recorded at the corresponding address, read out, updated based in the output of the second sensor or sensor section and re-recorded at the same address.

3 Claims, 40 Drawing Sheets

DUAL SENSOR TYPE AIR FUEL RATIO CONTROL SYSTEM FOR INTERNAL COMBUSTION ENGINE

This application is a divisional of application Ser. No. 07/645,975, filed Jan. 23, 1991.

BACKGROUND OF THE INVENTION

1. Field of the Invention

The present invention relates generally to an air/fuel ratio control system for an internal combustion engine and more specifically to an air-fuel ratio control system which utilizes the output of a dual oxygen concentration sensor arrangement to achieve feedback control of the fuel supply system.

2. Description of the Prior Art

The use of a so called three-way catalytic converter in an automotive exhaust system is well known. However, in order to achieve the simultaneous reduction of HC, CO and NOx, it is necessary to maintain the air-fuel mixture supplied to the combustion chamber or chambers of the engine at or very close to the stoichiometric air-fuel ratio (A/F) in order to maximize the conversion efficiency. The use of $O_2$ sensors for this purpose is also widely known.

However, as the output characteristics of $O_2$ sensors vary from one sensor to another, a problem is encountered in that the unit to unit deviations in the sensors induce errors in the feedback control of the fuel supply whereby the stoichiometric air-fuel ratio is not maintained in the desired manner and the efficiency of the three-way conversion in the catalytic converter is inhibited.

To overcome this problem is has been proposed in JP-A-58-72674 to use two $O_2$ sensors which are arranged as schematically illustrated in FIG. 1. As shown in this figure, one sensor 1 is disposed in an exhaust conduit 2 upstream of a 3-way catalytic converter 3 while the other 4 is disposed downstream thereof. The outputs of the two $O_2$ sensors are fed to a control unit 5 which in turn controls the amount of fuel injected by a fuel injector 6 disposed in the induction system 7 of an engine 8.

Similar arrangements are also disclosed in JP-A-1-113552 and U.S. Pat. No. 3,939,654 issued, on Feb. 24, 1976 in the name of Creps.

An example of the control implemented in connection with this type of system is depicted in flow chart form in FIGS. 2 to 4. The routine depicted in FIG. 2 is such as to utilize the output OSR1 of the upstream $O_2$ sensor to determine a feedback control factor Œ and is run at predetermined intervals (e.g. 4 ms) The first step of this routine is such as to determine if conditions (referred to as FRONT $O_2$ F/B) which permit the use of the upstream side $O_2$ sensor exist or not.

In the event that such conditions exist, for example: if the temperature of the engine coolant is not below a predetermined level of Tw; the engine is not being cranked/started; the engine has not just been started; the air-fuel mixture is not being deliberately enriched for engine warm-up; the output of the upstream $O_2$ sensor has not yet switched from one level to another; or the engine is not undergoing a fuel cut, then it is deemed that conditions which enable the use of the sensor exist and the routine should flow to step 1S2. In this step the output OSR1 of the upstream $O_2$ sensor is subject to A/D conversion, read and the value set in memory. In step 1S3 the instant value of OSR1 is compared with a slice level $SL_F$ (e.g. 0.45 volt) which is selected to represent the stoichiometric air/fuel ratio. In the event that the outcome is such as indicate that OSR1>$SL_F$ (viz., lean) the routine goes to step 1S4 wherein a flag F1 is cleared (i.e. F1=0), while in the event that OSR1>SLF the routine proceeds to step 1S5 wherein flag F1 is set (F1=1).

As will be appreciated flag F1 is such as to indicate if the air-fuel mixture is richer or leaner than stoichiometric value. F1=0=lean, F1=1=rich.

In steps 1S6 to 1S8 the status of F1 for this run is compared with that of the previous one in manner to establish four possible paths for the routine to follow to one of steps 1S9 to 1S12. In these latter mentioned four steps an air/fuel ratio feedback correction factor $\phi$ is subject following methods of derivation:

(i) In the case the routine flows from 1S6→1S7→1S9 the air-fuel ratio is indicated as just having undergone a rich→lean change and is derived by incrementing the instant value by a proportional component PL Œ = Œ+PL). This tends to incrementally enrich the air/fuel mixture and thus shift the air-fuel ratio stepwisely back toward the stoichiometric value.

(ii) In the case the routine follows a 1S6→1S7→1S10 path, the air-fuel mixture is indicated as just having undergone a lean→rich change. Accordingly is derived by decrementing the instant value by a proportional component PR ( = −PR). This tends to stepwisely lean the mixture back from the rich side.

(iii) In the case of a 1S6→1S8→1S11 flow, a previously lean condition is again detected and the value of is derived by adding an integrated component IL. This induces the A/F to return gradually toward the rich side.

(iv) In the event of a 1S6→1S8→1S11 flow, a previously rich condition is again detected and the value of is derived by subtracting an integrated component IR. This induces the A/F to return gradually toward the lean side.

The flow chart shown in FIG. 3 depicts a routine which utilizes the output of the downstream $O_2$ sensor for deriving an correction. This routine is run at predetermined intervals of 512 ms (for example). The reason for this relatively long delay between runs is to ensure that the feedback control which is primarily based on the output of the upstream $O_2$ sensor (which is highly responsive to the changes in A/F) is not dulled by overly frequent application of the output of the downstream $O_2$ sensor which, due to its position downstream of the catalytic converter, is is more remote and much less responsive to changes in the air-fuel mixture being combusted in the combustion chamber(s) of the engine.

At steps 2S21–2S25 the status of the downstream $O_2$ sensor is checked to determine if the output (REAR $O_2$ F/B) can be used for feedback control purposes. The output of the downstream $O_2$ sensor is deemed to be unsuitable for feedback control correction when the conditions which effect the upstream sensor are found to be unsuitable; when the engine coolant temperature is found to be less than Tw (in this case 70° C.)—step 2S22; when the engine throttle opening LL is is fully opened (LL=1)—step 2S23; when the engine load/engine speed ratio Qa/Ne<X1—step 2S24; or when in step 2S25 the downstream $O_2$ sensor is found not to have been activated.

In the event that the appropriate requirements can be met, indicating that conditions wherein the output of the downstream $O_2$ sensor can relied upon, the routine goes to step 2S26 wherein the output of the same OSR2 is A/D converted, read and set in memory. At step 2S27 the instant value of OSR2 is compared with a slice level $SL_R$. In this instance the slice level is selected to represent the stoichiometric air-fuel ratio (e.g. 0.55 volt). In the event that it is found that the $OSR2 \leqq SL_R$ the air-fuel mixture is deemed to be on the lean side and the routine flows to steps 2S28–2S31. On the other hand, if $OSR2 < SL_R$ the mixture is indicated as being on the rich side and the routine is directed to steps 2S32 to 2S35.

It should be noted that as the slice level SLR is set a little higher than $SL_F$ due to the fact that gases upstream and downstream of the catalytic converter are different and induce the sensors to exhibit slightly different output characteristics and to also allow for the different degradation rates between the two sensors.

At step 2S28 the PL value is incremented by a fixed value ΔPL. At step 2S29 the value of PR is decremented by a fixed value ΔPR. This has the effect of shifting the overall A/F in the rich direction.

At step 2S30 a constant value ΔIL is subtracted from the integrated component IL in order to reduce the amplitude at which Œ increases as a result of the increase of PL in step 2S28. At step 2S31, a constant value ΔIR is added to the integrated component IR in order to reduce the delay with which the output of the upstream $O_2$ sensor switches from rich to lean, it being noted that this delay is induced by the increase in the PR value in step 2S29.

When the A/F is indicated by the output of the upstream $O_2$ sensor to be on the lean side, Œ correction control which is implemented in steps 2S28 to 2S31 changes the wave form from that shown in upper half of FIG. 5 to that shown in the lower half of the same figure.

Under the conditions wherein Œ is asymmetrical (e.g. PL=8% and PR=2%) and the intervals between the switches in the sensor output are relatively long, the changes in A/F with respect to the stoichiometric value are or such a large amplitude as to reduce the purifying performance of the catalytic converter.

To overcome this problem the values of IL is modified to reduce the Œ amplitude while the IR value is decreased in order to decrease the delay with which the output of the upstream $O_2$ sensor switches (viz., reduce the reversing intervals in the feedback control).

The wave form shown in the upper half of FIG. 6 is similarly changed to that shown in the lower half by steps 2S32 to 2S35.

FIG. 4 shows a routine which is run at uniform crankshaft rotation angle intervals (e.g. 30° CA)and which is used to derive the fuel injection pulse width Ti [ms]. The first step 3S31 is such as to derive the basic injection pulse width Tp by table look-up using data which is recorded in terms of engine speed and the engine load. Following this in step 3S32, the sum of a plurality of correction factors (e.g. engine temperature related correction factor KTW) is calculated and at step 3533 the actual injection pulse width Ti is derived using the equation:

$$Ti = Tp \times Co \times Œ + Ts \quad (1)$$

where Ts denotes the rise time of the fuel injector(s).

In step 3534 the derived value of Tis is set in memory and used to produce the appropriate injection pulse(s).

However, with this type of arrangement the delay in the response of the downstream $O_2$ sensor is unchangeably set a relatively large interval with the result that the correction control of the Œ value based on the downstream $O_2$ sensor cannot take changing conditions into account whereby appropriate correction during acceleration and the like type of transient conditions is impossible.

As a result the above type of control has left a lot to be desired in control accuracy and A/F ratio control A second type of previously proposed control is disclosed in flow chart form in FIGS. 7 and 8. The first step of the routine depicted in FIG. 7 is such as to determine if conditions FRONT 02 F/B are such that the output of the front or upstream $O_2$ sensor can be accepted for control purposes or not. These conditions are for obvious reasons essentially the same as those previously discussed in connection with step 1S1. As in the above case, if the suitable conditions do not prevail then the routine simply goes to across to step 4S10 wherein the value of Œ is arbitrarily set equal to 1.0.

However, in the event that conditions under which the output VFO of the upstream $O_2$ sensor can be accepted for control purposes exist, the routine goes to step 4S4 wherein a suitable slice level value SL is obtained by look-up. Following this at step 4S3 the instant VFO value is compared with the just obtained SL value in order to determine if the output voltage of the sensor has switched from a maximum level to a minimum one or vice versa. In the event that it is found that $VFO \geqq SL$, the mixture is deemed to on the rich side. On the other hand, if $VFO < SL$ then the mixture is indicated as being leaner than stoichiometric.

Steps 4S6 to 4S9 the A/F feedback correction factor is derived depending on the outcome of the comparison conducted in step 4S3. As will be apparent, these steps and the manner in which the routine is directed thereto, are the same as disclosed above in connection with steps 1S9–1S12 of the flow chart shown in FIG. 2. Accordingly, redundant disclosure of the same will be omitted for brevity.

FIG. 8 shows a routine in flow chart form which is run at predetermined uniform intervals and which corrects the slice level SL based on the output VRO of the rear or downstream $O_2$ sensor. The first step (5S21) of this routine is such as to determine if conditions which permit the use of the VRO signal, prevail or not. This determination is carried out in essentially the same manner as disclosed in connection with step 2S21 disclosed above.

In the event suitable conditions are found to be present the routine flows to step 5S22 wherein the value of VRO which has been A/D converted and read into memory, is compared with a slice level SL2 which is selected to correspond to the stoichiometric air-fuel ratio. In the event that is found that $VRO < SL2$, indicating that the A/F is on the lean side, then the routine goes to step 5S23 wherein the value of SL is decremented by a preset amount. On the other hand, if the $VRO \geqq SL2$ (indicating a rich mixture) then at step 5S25 the value of SL is incremented by the above mentioned preset amount.

Thus, when the routine flows through step 5S25 the value of the slice level is increased and induces the period for which the A/F stays on the lean side from TL to TL' (see FIG. 9). On the other hand, when the routine flows through step 5S23 the value of SL is decreased and thus induce the tendency for the A/F ratio to remain on the rich side.

The upper half of FIG. 9 depicts the ratio of the time for which the A/F is rich with respect to the time for which it is lean. In order to reduce this ratio the slice level SL is increased in accordance with the output of the downstream $O_2$ sensor.

However with ths type of control, the correction of the slice level based on the output of the downstream $O_2$ sensor cannot be by performed with sufficiently high efficiency when the front or upstream $O_2$ sensor exhibits fast response characteristics.

The reason for this is that the wave form of the upstream $O_2$ sensor output, which is shown in the lower half of FIG. 9, is based on actually measured values (note that the wave form per se is modelled). The response time reduces as the inclination of the leading and trailing edges increases.

When a sensor which exhibits fast response characteristics is used, the ratio H changes at a relatively slow rate when the SL varies at a relatively high rate. Accordingly, the range in which the A/F can shift is narrow and the A/F ratio error absorbing capacity is limited.

Irrespective of the fact that the downstream $O_2$ sensor exhibits a substantial delay, the correction of the slice level is constant despite changes in the operating conditions. Accordingly, it is difficult to eliminate the A/F errors under all modes of operation. This of course gives rise to an increase in the amount of exhaust emissions.

SUMMARY OF THE INVENTION

It is an object of the present invention to provide a fuel injection control system of the above described nature which is free from the error which inherently results from using the output of the relatively slow responding downstream $O_2$ sensor.

It is a further object of the present invention to average the output of the upstream $O_2$ sensor, compare this average with a slice level, and generating an updated slice level for each of a plurality of engine operational sub-regions.

It is a further object of the invention to provide a system which takes upstream $O_2$ sensor deterioration into account by modifying the above mentioned averaging.

It is another object of the invention to provide a system which improves A/F control but which avoids complex control, complex manufacturing processes and high costs.

In brief, the above objects and others are basically achieved by an arrangement wherein a learning or updating function, which corrects the feedback control correction factor Œ, is included in a dual $O_2$ sensor type control system. Correction related data which is used to modify Œ in response to the output of an upstream sensor or sensor section, is recorded at memory addresses which corresponding to the sub-sections of an engine operation map. When the output of the upstream sensor changes, a sub-region in which the engine operation fell a time $\tau$ earlier or in which the engine operation has continuously fallen for the time $\tau$, is selected and the correction related data which is recorded at the corresponding address, read out, updated based in the output of the second sensor or sensor section and re-recorded at the same address.

More specifically a first aspect of the present invention comes in an air-fuel ratio feedback control system which features: first sensor means; second sensor means; a control unit operatively connected with the first and second sensor means, the control unit comprising: memory means containing an engine operation map which is divided into a predetermined number of sub-regions and corresponding data address at which data which corresponds the sub-region can be stored; means for comparing the output of the first sensor means with a first predetermined level and for determining when the output of the first sensor means traverses the first predetermined level; means for reading out the data which is recorded at the memory address which corresponds to the sub-region which was identified a predetermined time before the output of the first sensor traversed the first predetermined level or in which the operation has continued to fall for the predetermined time following the output of the first sensor traversing the first predetermined limit; means for comparing the output of the second sensor means with a second predetermined level and for determining if the output is indicative of a mixture richer or leaner than a predetermined target ratio; and means responsive to the output of the second sensor for updating the data which is read out and for storing the updated data at the address from which it was read out.

A second aspect of the present invention comes in a method of operating an air-fuel ratio feedback control system, which features the steps of: comparing the output of a first sensor means with a first predetermined level and for determining when the output of the first sensor means traverses the first predetermined level; determining from mapped engine operational data which is divided into a predetermined number of sub-regions and corresponding data addresses at which data which relates to the sub-region is stored, the data which is recorded at a memory address which corresponds to a sub-region which was identified a predetermined time before the output of the first sensor traversed the first predetermined level or the sub-region in which the operation has continued to fall for the predetermined time following the output of the first sensor traversing the first predetermined limit; comparing the output of the second sensor means with a second predetermined level and for determining if the output is indicative of a mixture richer or leaner than a predetermined target ratio; updating, in response to the output of the second sensor, the determined data which is read out; and storing the updated data at the address from which it was read out.

A third aspect of the present invention comes in an internal combustion engine air-fuel ratio control apparatus which features: an engine load sensor; an engine speed sensor; means for determining a basic fuel injection quantity based on the outputs of the engine load and speed sensors; a first sensor disposed in an exhaust passage at a location upstream of a catalytic converter for producing an output indicative of the air-fuel ratio of the exhaust gases; means for comparing the output of the first sensor with a first target level and for determining on which side of the target level the output is and when the output traverses the first target level; means for deriving an air-fuel ratio feedback control correction factor used for feedback control of the air-fuel ratio, the feedback control correction factor bringing the air-fuel ratio closer to the first target level; memory means including a plurality of addresses and corresponding engine operational sub-regions, the address storing correction values for the corresponding operational sub-region; means for determining in which of the sub-regions the current engine operation falls in; means for reading out the correction value which is stored at the address which corresponds to the determined sub-region; means for correcting the feedback control correction factor using the correction value which is read out; means for deriving a fuel injection amount by correcting the basic fuel injection quantity using the feedback control correction factor; a second sensor disposed in the exhaust passage downstream of the catalytic converter; means responsive to the output of the first sensor traversing the first target level for determining which of the sub-regions the engine operation has continuously fallen in for a predetermined period; means responsive to the identification of a sub-region in which the engine operation has continuously fallen for the predetermined period, for comparing the output of the second sensor with a second target level; and means for updating the correction value in accordance with the comparison of the second sensor with the second target level.

A fourth aspect of the present invention comes in an internal combustion engine air-fuel ratio control apparatus comprising: an engine load sensor; an engine speed sensor; means for determining a basic fuel injection quantity based on the outputs of the engine load and speed sensors; a first sensor disposed in an exhaust passage at a location upstream of a catalytic converter for producing an output indicative of the air-fuel ratio of the exhaust gases; means for comparing the output of the first sensor with a first target level and for determining on which side of the target level the output is, and when the output traverses the first target level; means for deriving an air-fuel ratio feedback control correction factor used for feedback control of the air-fuel ratio, the feedback control correction factor bringing the air-fuel ratio closer to the first target level; memory means including a plurality of addresses and corresponding engine operational sub-regions, the address storing correction values for the corresponding operational sub-region; means for determining in which of the sub-regions the current engine operation falls in; means for reading out the correction value which is stored at the address which corresponds to the determined sub-region; means for correcting the feedback control correction factor using the correction value which is read out; means for deriving a fuel injection amount by correcting the basic fuel injection quantity using the feedback control correction factor; a second sensor disposed in the exhaust passage downstream of the catalytic converter; means responsive to the output of the first sensor traversing the first target level for determining which of the sub-regions the engine operation fell in a predetermined period before the traversal; means for reading the correction value out of the sub-region in which the engine operation fell a predetermined time before the traversal; means for comparing the output of the second sensor with a second target level; and means for updating the correction value in accordance with the comparison of the second sensor with the second target level.

A fifth aspect of the present invention comes in an internal combustion engine air-fuel ratio control apparatus which features: an engine load sensor; an engine speed sensor; means for determining a basic fuel injection quantity based on the outputs of the engine load and speed sensors; a first sensor disposed in an exhaust passage at a location upstream of a catalytic converter for producing an output indicative of the air-fuel ratio of the exhaust gases; means for averaging the output of the first sensor; memory means including a plurality of addresses and corresponding engine operational sub-regions, each address storing first and second slice level values; means for determining in which of the sub-regions the current engine operation falls in; means for reading out the first slice level value which is stored at the address which corresponds to the determined sub-region; means for comparing a working slice level value which is based on the first slice level which is read out, with the output of the averaged output of the first sensor and determining if the output of the first sensor traverses the read out slice level value; means for deriving an air-fuel ratio feedback control correction factor used for feedback control of the air-fuel ratio in a manner which brings the air-fuel ratio closer to the first target level; means for deriving a fuel injection amount by correcting the basic fuel injection quantity using the feedback control correction factor; a second sensor disposed in the exhaust passage at a location downstream of the catalytic converter; means for determining if the engine operation continuously falls in the same sub-region for a predetermined time following the output of the first sensor having traversed the first slice level; means for reading out the first and second second slice level values stored at the address which corresponds to the sub-region in which the engine operation has fallen for the predetermined time following the traversal of the working slice level by the output of the first sensor; means for comparing the output of the second sensor with the second slice level; and means for updating the values of the first and second slice levels in accordance with the comparison of the output of the second sensor with the second slice level.

A sixth aspect of the present invention comes in an internal combustion engine air-fuel ratio control apparatus which features: an engine load sensor; an engine speed sensor; means for determining a basic fuel injection quantity based on the outputs of the engine load and speed sensors; a first sensor disposed in an exhaust passage at a location upstream of a catalytic converter for producing an output indicative of the air-fuel ratio of the exhaust gases; means for averaging the output of the first sensor; memory means including a plurality of addresses and corresponding engine operational sub-regions, each address storing first and second slice level values; means for determining in which of the sub-regions the current engine operation falls in; means for reading out the first slice level value which is stored at the address which corresponds to the determined sub-region; means for comparing a working slice level which is based on the first slice level value which is read out, with the output of the averaged output of the first sensor and determining if the output of the first sensor traverses the working slice level value; means for deriving an air-fuel ratio feedback control correction factor used for feedback control of the air-fuel ratio in a manner which brings the air-fuel ratio closer to the first target level; means for deriving a fuel injection amount by correcting the basic fuel injection quantity using the feedback control correction factor; a second sensor disposed in the exhaust passage at a location downstream of the catalytic converter; means for determining if the engine operation continuously falls in the same sub-region for a predetermined time following the output of the first sensor traversing the working slice level; means for reading out the first and second second slice level values stored at the address which corresponds to the sub-region in which the engine operation has fallen for the predetermined time following the traversal of the first slice level by the output of the first sensor; means for comparing the output of the second sensor with the second slice level; and means for updating the values of the first and second slice levels in accordance with the comparison of the output of the second sensor with the second slice level means for comparing the value of the updated first slice level with maximum and minimum values; means for indicating that the first sensor is undergoing degradation when the updated first slice level value is greater than the maximum value or less than the minimum value; and means for for modifying the averaging of the output of the first sensor accordance with the indication that the first sensor is undergoing degradation.

A seventh aspect of the present invention comes in an air-fuel ratio sensor which features: a first sensor section including a first reference electrode and a first measuring electrode formed on a first piece of oxygen ion conductive solid electrolyte; a first porous layer formed over the first measuring electrode; a second sensor section including a second reference electrode and a second measuring electrode formed on a second piece of oxygen ion conductive solid electrolyte; a second porous layer formed over the second measuring electrode, the second porous layer including a catalyst which is carried thereon.

Another aspect of the present invention comes in an air-fuel ratio sensor which features: a first sensor section including a first reference electrode and a first measuring electrode formed on a first piece of oxygen ion conductive solid electrolyte; a first porous layer formed over the first measuring electrode; a second sensor section including a second reference electrode and a second measuring electrode formed on a second piece of oxygen ion conductive solid electrolyte; a second porous layer formed over the second measuring electrode, the second porous layer including a catalyst which is carried thereon.

A further aspect of the invention comes in an internal combustion engine air-fuel ratio control system which features: a sensor, the sensor including first and second sensor sections which each have reference and measuring electrodes, the reference electrodes of the first and second sensor sections being exposed to a common reference chamber; a control circuit operatively connected with sensor, the the control circuit including: memory means containing mapped data which is divided into a predetermined number of sub-regions and corresponding data address at which correction related data for the sub-region is stored; means responsive to the outputs of the first and second sensor sections for updating, based on the output of the second section and in a predetermined timed relationship with the changes in the level of the output of the first sensor section, the correction related data from an address corresponding to a sub-region in which engine operational parameters have continuously fallen for a predetermined time or in which the engine operational parameters fell the predetermined time before the change in the output level of the first sensor section.

A yet another aspect of the present invention comes in an internal combustion engine air-fuel ratio control system which features: a catalytic converter; a first sensor disposed upstream of the catalytic converter; a second sensor disposed downstream of the catalytic converter; a control circuit operatively connected with the first and second sensors, the control circuit including: memory means containing mapped data which is divided into a predetermined number of sub-regions and corresponding data address at which correction related data for the sub-region is stored; means responsive to the outputs of the first and second sensors for updating, based on the output of the second sensor and in a predetermined timed relationship with the changes in the level of the output of the first sensor, the correction related data from an address which corresponds to a sub-region in which engine operational parameters have continuously fallen for a predetermined time or in which the engine operational parameters fell the predetermined time before the change in the output level of the first sensor section.

DETAILED DESCRIPTION OF THE PREFERRED EMBODIMENTS

Figure 11:
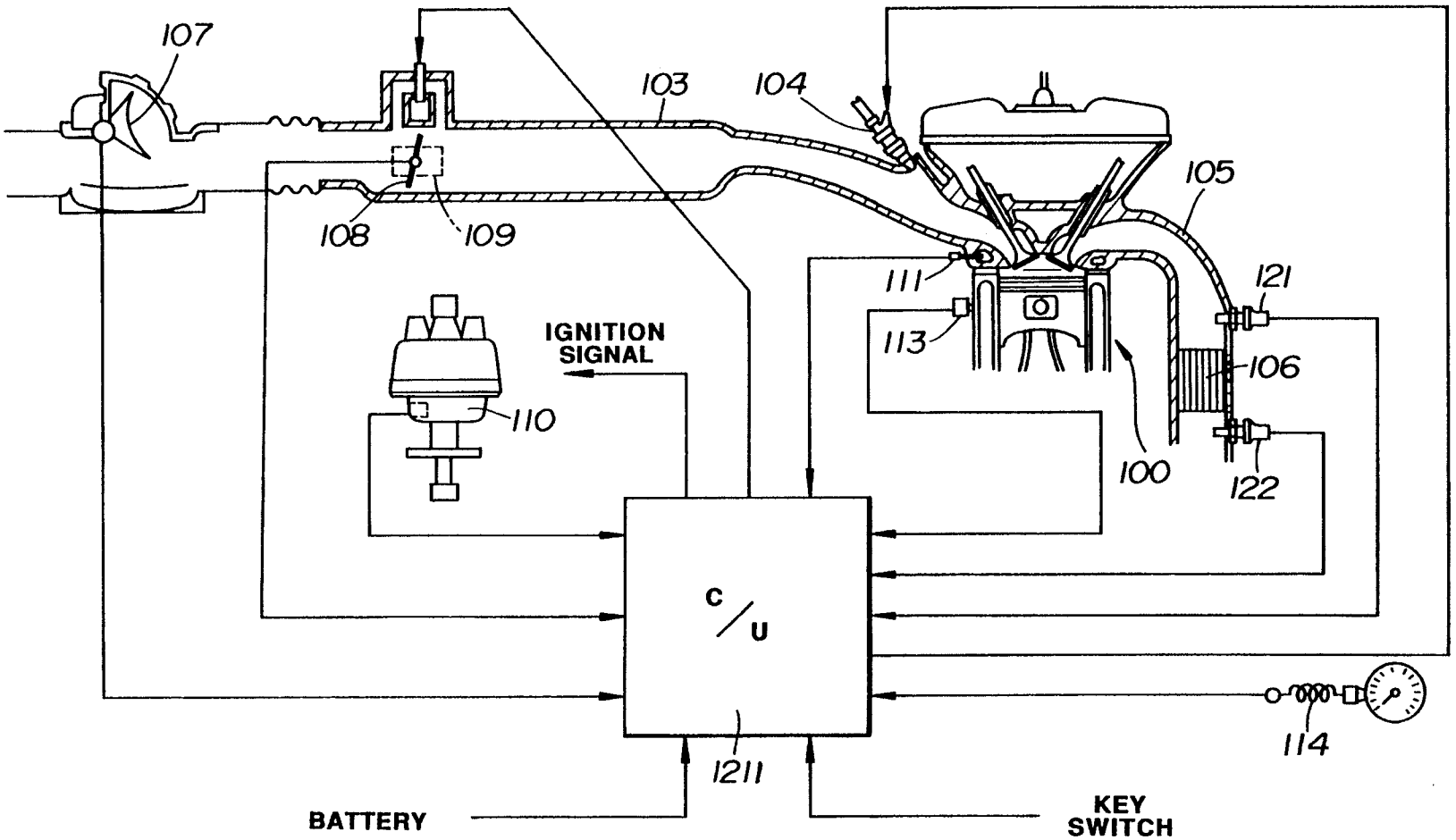
FIG. 11 is a schematic view of an engine system of the nature to which some of the embodiments of the present invention are applicable.

FIG. 11 shows an engine system to which the embodiments of the invention which utilize completely separate $O_2$ sensors, are applicable. Briefly, this system includes an engine 100, which is supplied air via an air cleaner (not shown) and an induction conduit 103. A fuel injector 104 is disposed in the induction conduit in a manner to inject fuel into the air flowing through the conduit 103 toward the engine 100.

The induction conduit 103 further includes an ISC vacuum limiting valve and by-pass passage arrangement. As shown in this figure, the by-pass passage is arranged to communicate with the throttle chamber in a manner which by-passes the throttle valve 8.

An exhaust conduit 105 includes a 3-way catalytic converter 106.

A control unit 1211 receives data inputs from an air flow meter 107 which is disposed in an upstream section of the induction conduit 103, a throttle valve position sensor 109; an engine speed/crank angle sensor 110, a coolant temperature sensor 111, a knock sensor 113, a vehicle speed sensor 114, and upstream and downstream $O_2$ sensors 121,122.

As the manner in which the above listed elements and there possible equivalents cooperate with one another is very well known and not directly related to the point of the invention, discussion of the same will be omitted for the sake of brevity.

In the illustrated arrangement the $O_2$ sensors are of the type wherein the output tends to be binary and changes abruptly in response to very small deviations in the A/F from the stoichiometric ratio. It should be noted however, that the present invention is not limited to the same and that sensors of the "over-range" or lean type can be used in lieu thereof.

Figure 12:
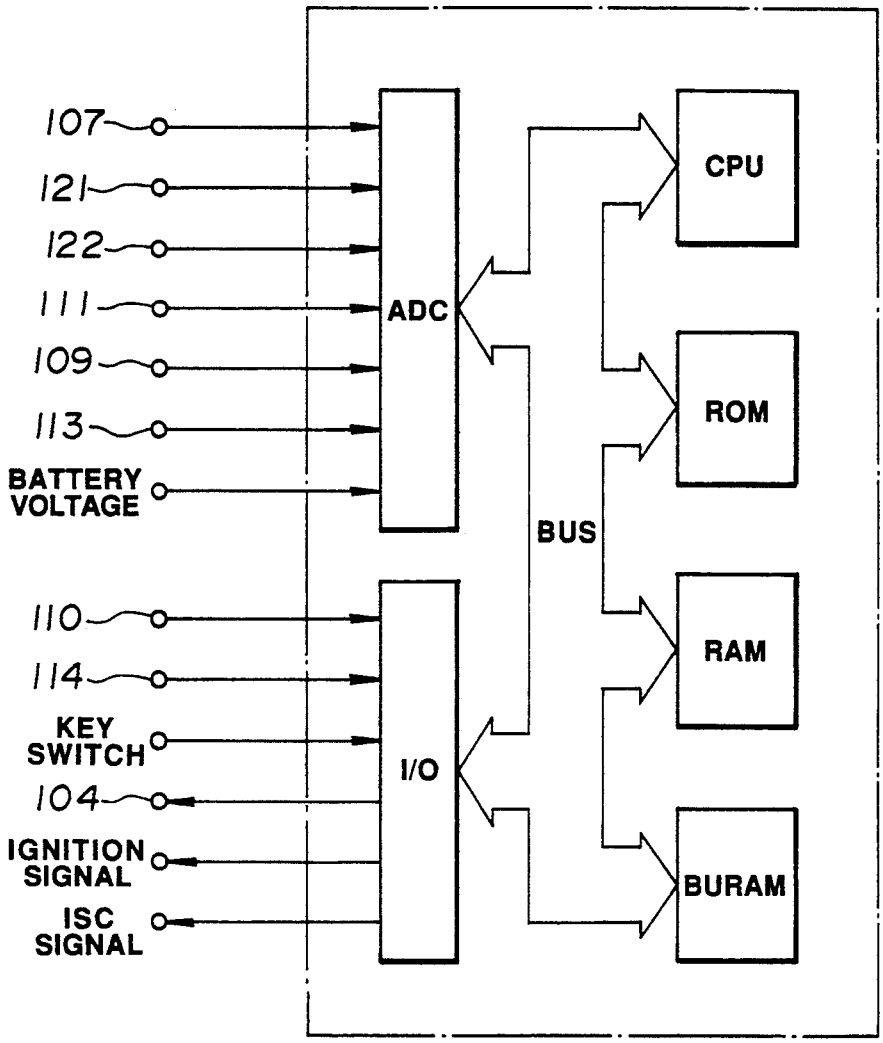
FIG. 12 is a schematic diagram showing a microprocessor arrangement which forms a part of the control unit shown in FIG. 11.

FIG. 12 is a block diagram which schematically depicts a microprocessor arrangement which is included in the control unit 1211. Programs which include a "learning" or self-updating function are stored in the memory of this device.

Figure 13A:
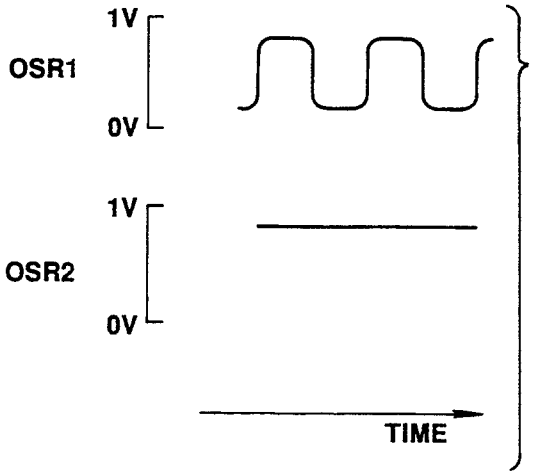
FIGS. 13A–B are timing charts showing the manner in which, during feedback control of the air-fuel ratio, the switching of the $O_2$ sensor between rich and lean indications, takes place.
Figure 13B:
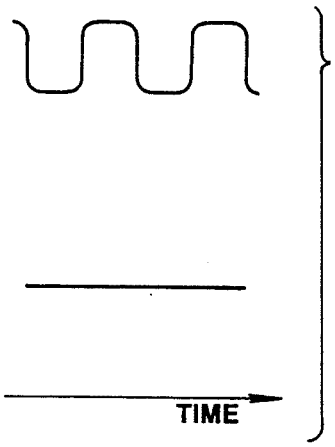

FIGS. 13A–B shows the manner in which the outputs OSR1 and OSR2 of the upstream and and downstream $O_2$ sensors vary when the A/F cannot be controlled to the required target value due to the delay in the response of the downstream $O_2$ sensor and the resulting mismatching of the control constant. As will be appreciated, as the frequency with which the feedback control is maintained constant, the output OSR1 synchronously hunts back and forth between rich (1 v) and lean (0 v). On the other hand, the output OSR2 of the downstream $O_2$ sensor remains either rich or lean for relatively prolonged periods. Accordingly, the output of the downstream sensor is relied upon to determine if the mixture is rich or lean.

Figure 14A:
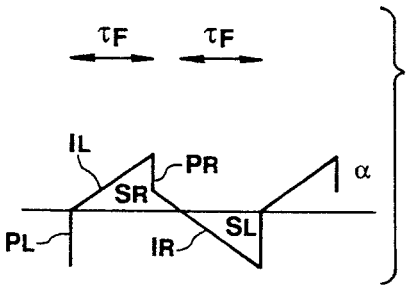
FIGS. 14A–B are timing correction factor $\alpha$ wave forms which occur when the A/F indication switches between rich and lean.

In the case of FIG. 13A wherein the mixture is indicated as being rich, it is appropriate to shift the A/F toward the lean side. For example, as shown in FIG. 14A of FIG. 14 if one proportional component (e.g. PL) is greater than the other (PR), SR becomes larger than SL and the average A/F is shifted in the rich direction. However, it should be noted that SR and SL are respectively above and below the CE target value line.

Figure 14B:
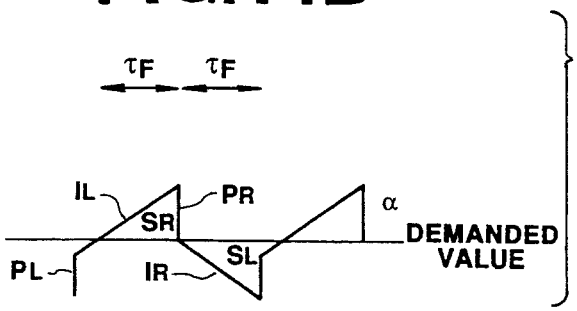

In the same manner, as shown in FIG. 13A when the air-fuel ratio is on the lean side if the proportional component PR is increased the air-fuel ratio shifts in the lean direction as indicated in FIGS. 14A–B.

However, as shown in FIGS. 14A–B of FIG. 14, inducing the shift in air-fuel ratio is not limited to the proportional components PL, PR and it is possible to change the integrated components IR, IL, the air-fuel ratio determination delay time or the slice level with which the upstream $O_2$ sensor output is compared with. That is to say, these are control factors used in the feedback control.

Figure 15:
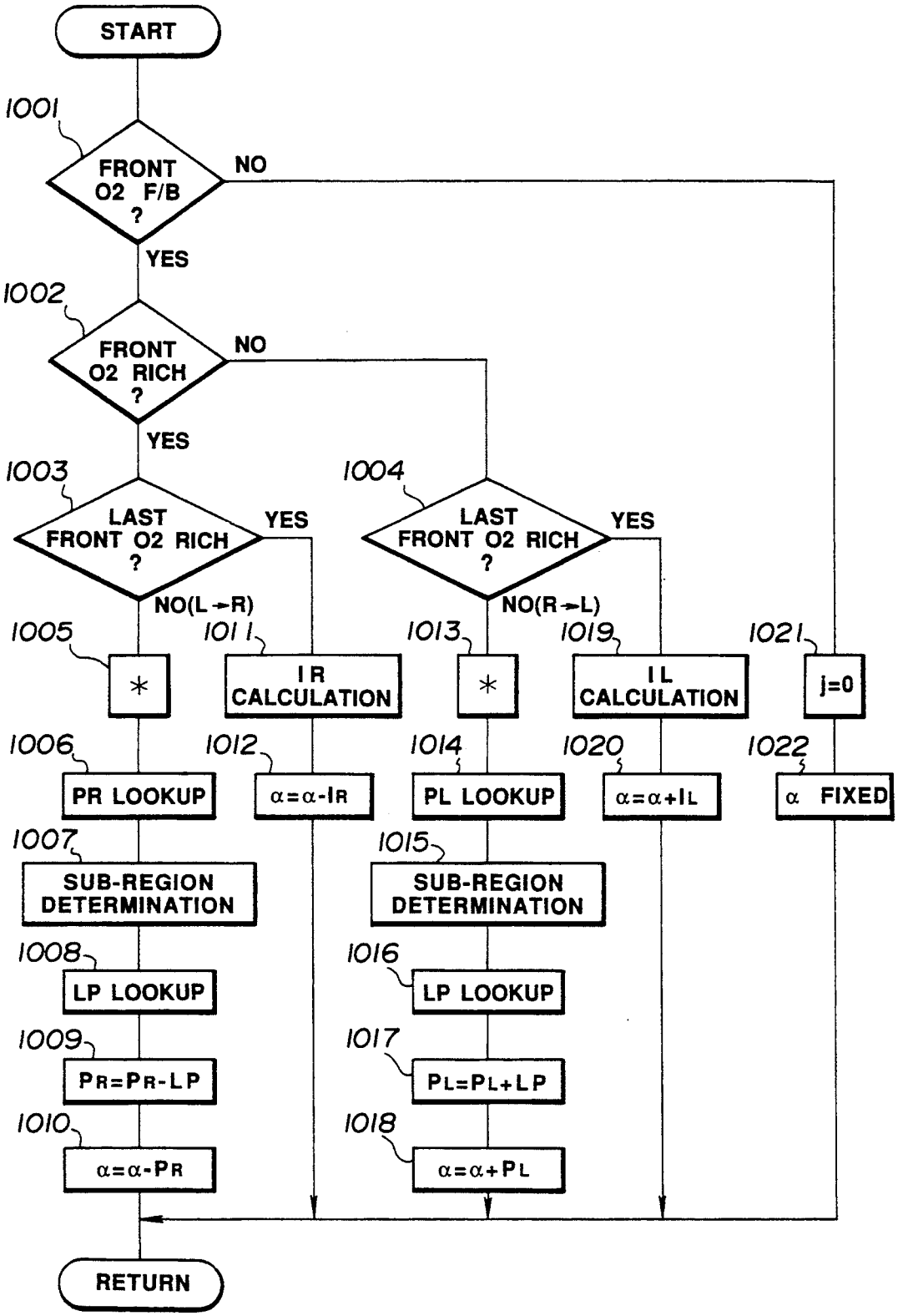
FIGS. 15 and 16 show flow charts which depict, in flow chart form, the operation which characterizes a first embodiment of the present invention.
Figure 16:
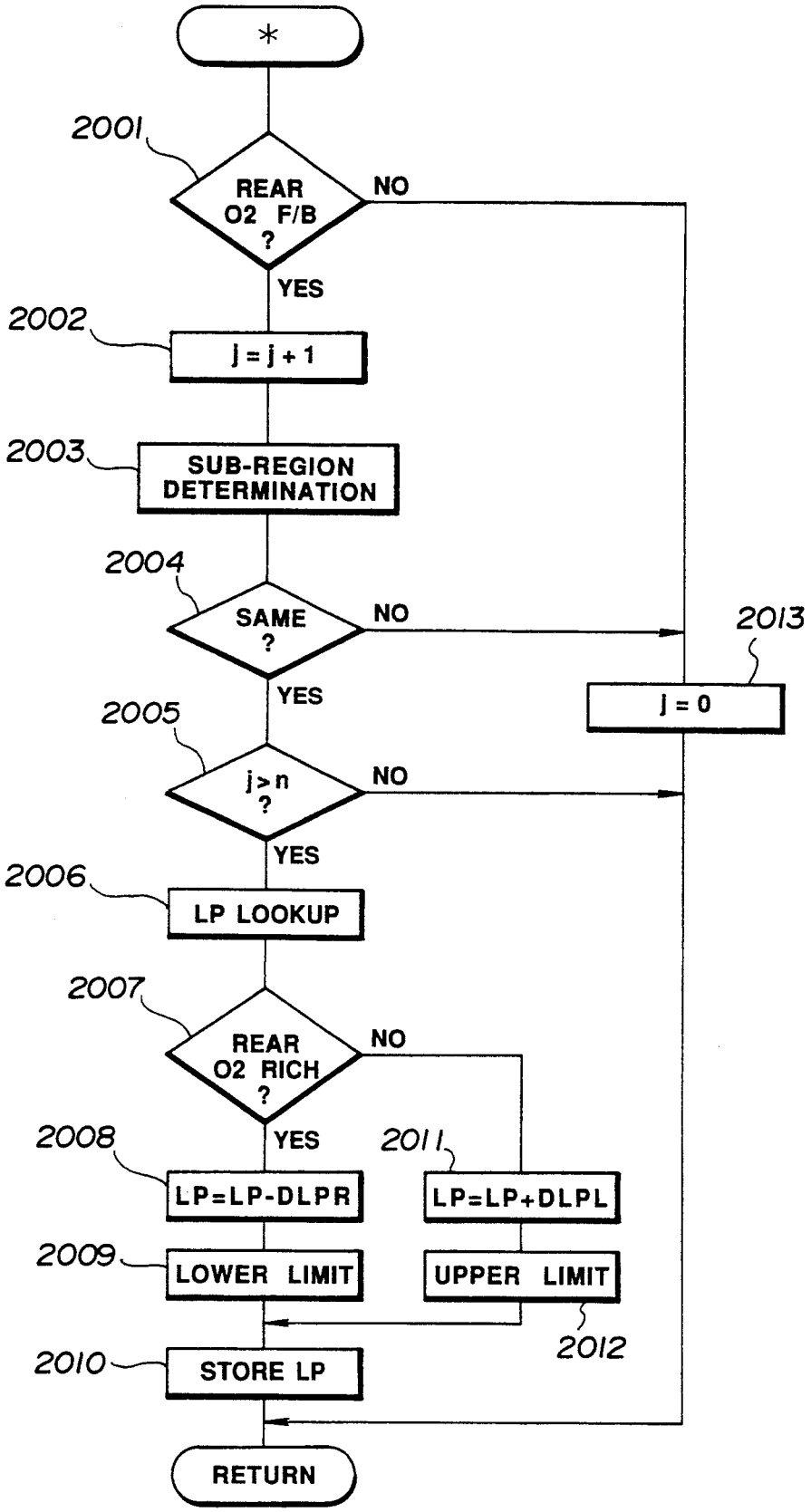

FIGS. 15 and 16 show in flow chart form, routines which are arranged to shift the air-fuel ratio by utilizing the proportional components PL, PR of the control constants. FIG. 16 shows a feedback control routine which utilizes the upstream $O_2$ sensor output and which is run in synchronism with engine rotation.

In step 1001, the status of the front or upstream $O_2$ sensor is checked to determine if the conditions which permit the output of the same to be used for feedback purposes, prevail or not. In step 1002 it is determined if the output of the sensor indicates a rich mixture or not. Viz., the output OSR1 is compared with slice level SLF In the event of an affirmative outcome the routine goes on to step 1003 wherein it checked to determine if the output has switched from one side of the slice level to the other in order to determine if the air-fuel ratio on the last run was rich or has changed from lean to rich.

In the case of a negative outcome the routine goes to step 1005 wherein a command to run the routine shown in FIG. 16 is issued.

Steps 1006, 10011, 1014 and 1019 are such as to determine basic control factors. Depending on the outcome of step 1003, the proportional components PL, PR and the integrated components are obtained from tabled data.

"iR calculation" and "IL calculation" in steps 1011 and 1019 indicate that the IR and IL values are derived by multiplying the engine load (e.g. the injection pulse width Ti) by iR and iL which are obtained from tabled data or maps as they will be referred to hereinafter. Viz.:

$$IR = iR \times Ti \quad (2)$$

$$IL = iL \times Ti \quad (3)$$

It will be noted that the engine load parameter is not limited to the Ti value and Tp+OFST (where OFST denotes a predetermined offset value) can be used if so desired.

Steps 1007 and 1015 are such as to determine which engine operational sub-region current engine operation falls in. This is done by reading the instant engine speed and load-values and using table data of the nature shown in FIG. 17.

Figure 33:
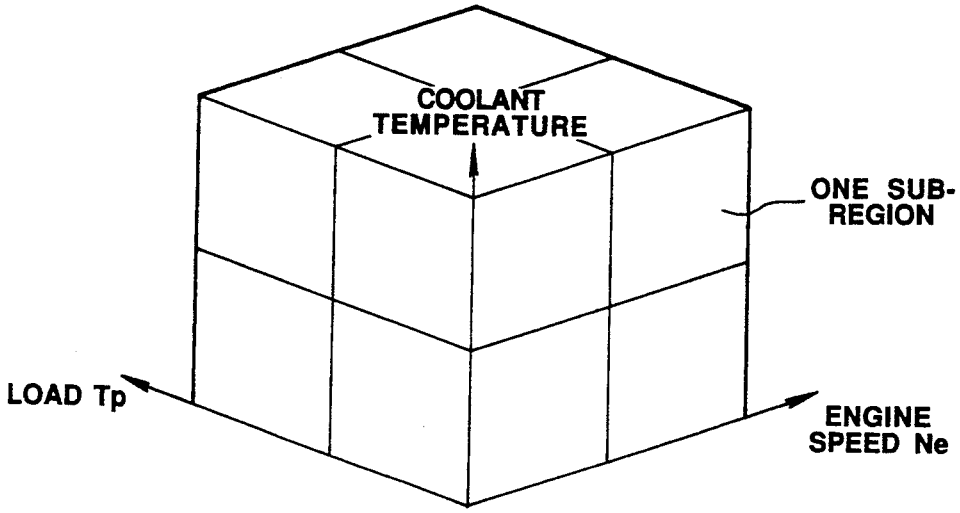
FIGS. 33 and 34 are diagrams which depict in a three-dimensional form, the manner in which the subregions and so called "learned" or updated MSL data, which is used in the some of the embodiments of the invention is arranged.
Figure 34:
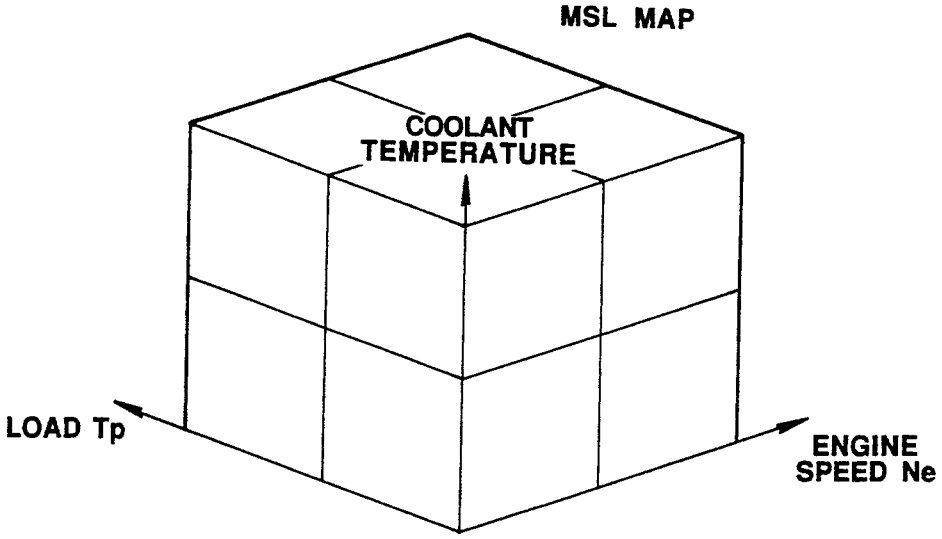

It will be noted that the total number of sub-regions is determined by the amount of memory which is available for the same in the microprocessor. It will also be noted that division is not limited to the engine speed and load parameters indicated in FIG. 17 and that an additional parameter such as engine coolant temperature Tw can be added (see FIGS. 33 and 34 by way of example).

Figure 17:
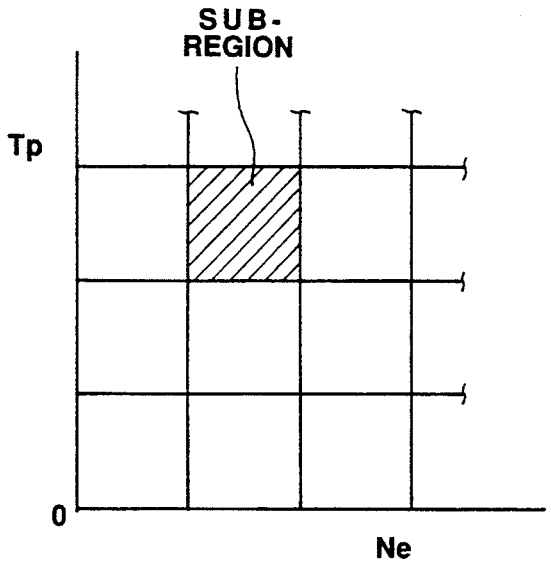
FIG. 17 is a diagram which depicts in terms of injection pulse width Tp (engine load) and engine speed Ne, mapped data in which engine operation is divided into sub-regions.
Figure 18:
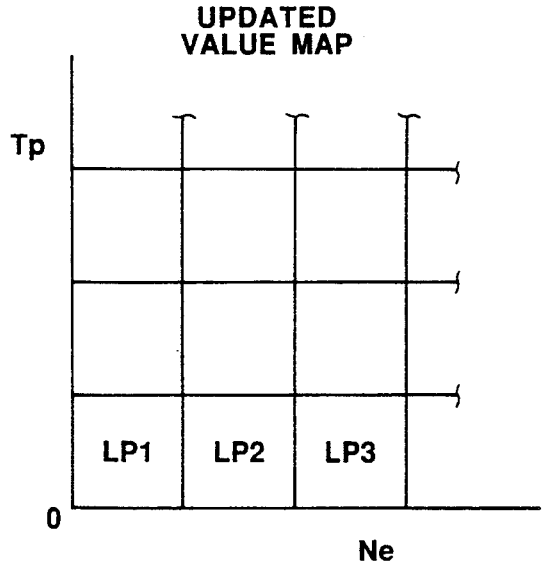
FIG. 18 is a diagram showing a "learned" or updated control map used in connection with the present invention.

Steps 1008 and 1016 are such as to read out the so called "learned" or updated LP value from a map of the nature shown in FIG. 18 and which is stored in the RAM shown in FIG. 12. It will be noted that the divisions in this map correspond in number and location to the sub-regions in the map of FIG. 17 In other words when the engine is found to be operating in a predetermined sub-region, the LP value which is currently stored at the corresponding address in the map of FIG. 18, is fetched.

At steps 1009 and 1017 the values of the proportional components PR and PL are derived using the following equations:

$$PR = PR - LP \quad (4)$$

$$PL = PL + LP \quad (5)$$

Using these equations it is possible, in the event that the output of the upstream $O_2$ sensor is off target in either direction, to update LP values in a manner which obviates the error and brings the output back to the desired level.

Steps 1010, 1012, 1018, 1020 are such as to calculate the air-fuel ratio feedback correction factor Œ using the proportional components derived as described above.

Figure 1:
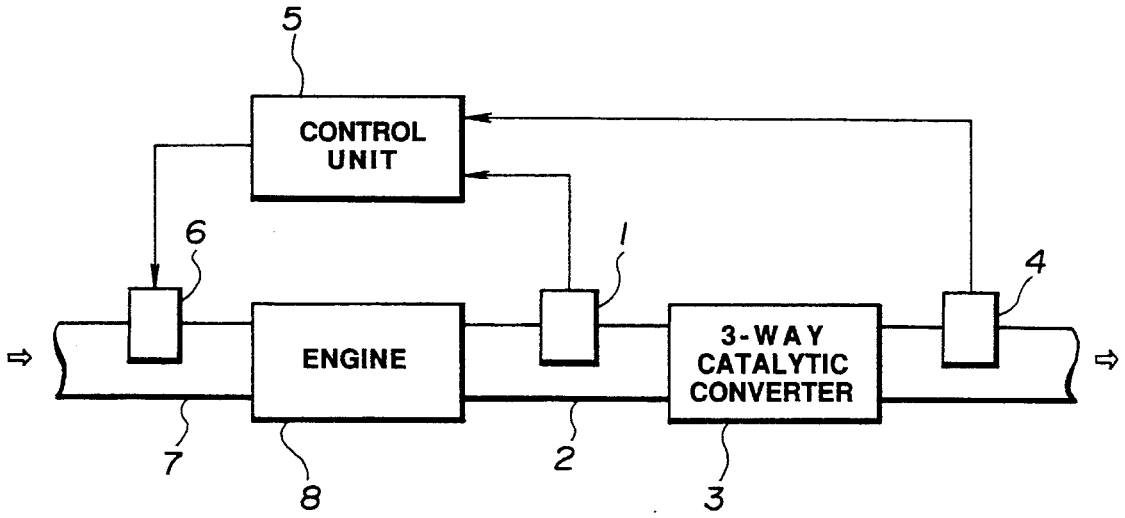
FIG. 1 PRIOR ART
FIG. 1 is a schematic drawing showing the basic layout of the previously proposed dual $O_2$ sensor arrangement discussed in the opening paragraphs of the instant disclosure.
Figure 4:
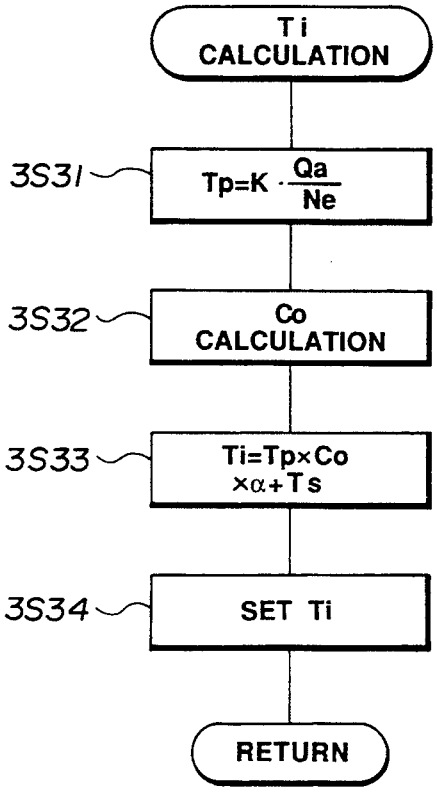
FIG. 4 PRIOR ART
FIGS. 2–4 are flow charts which depict the operations performed in accordance with a first previously proposed control arrangement for use with dual $O_2$ sensor type arrangements of the nature shown in FIG. 1.
Figure 2:
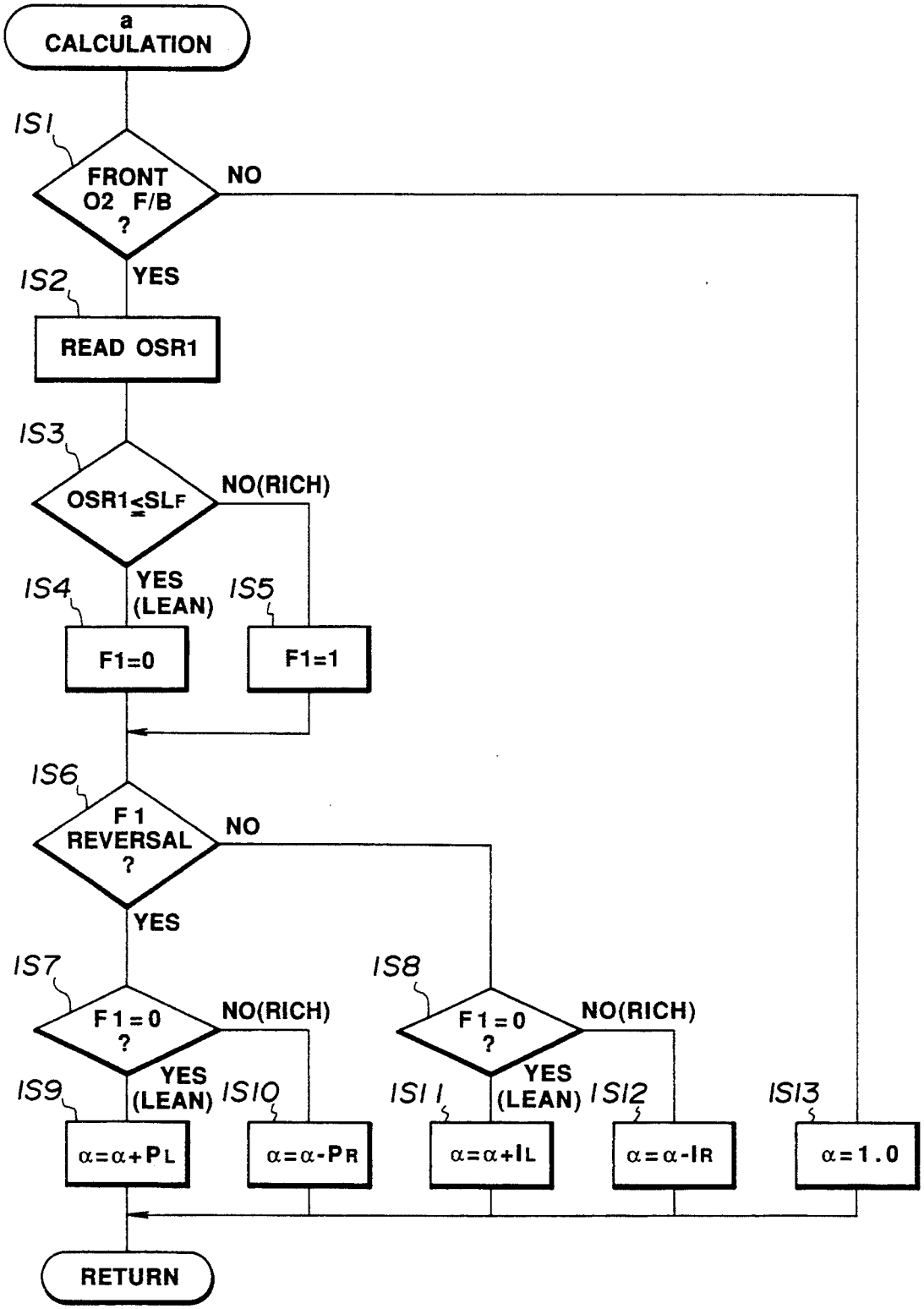
FIG. 2 PRIOR ART
Figure 3:
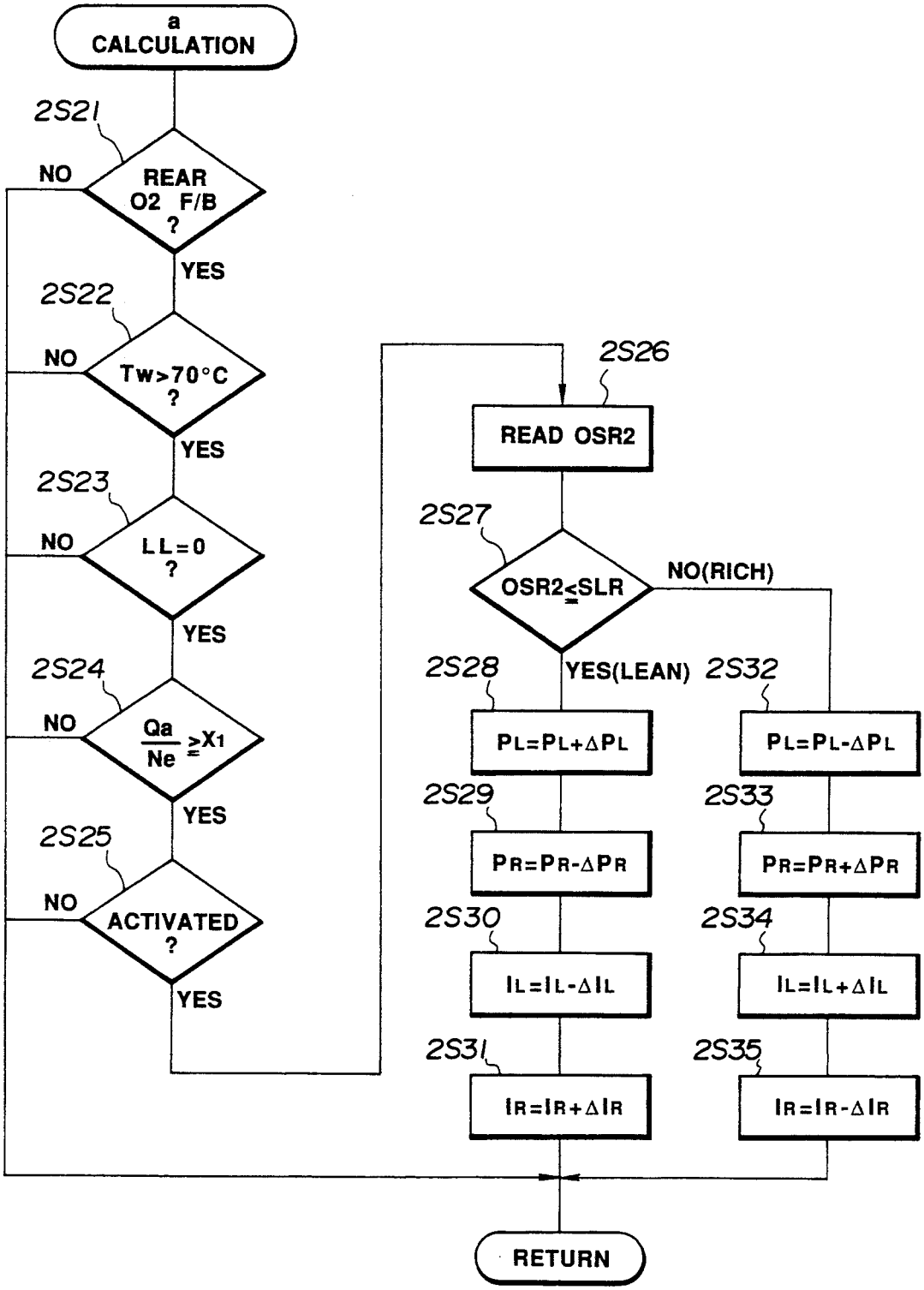
FIG. 3 PRIOR ART
Figure 5:
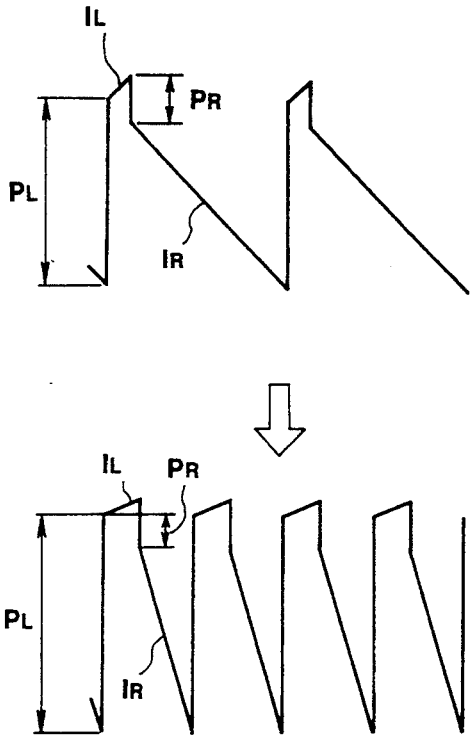
FIG. 5 PRIOR ART
FIGS. 5 and 6 show graphically the manner which the above mentioned control arrangement functions.
Figure 6:
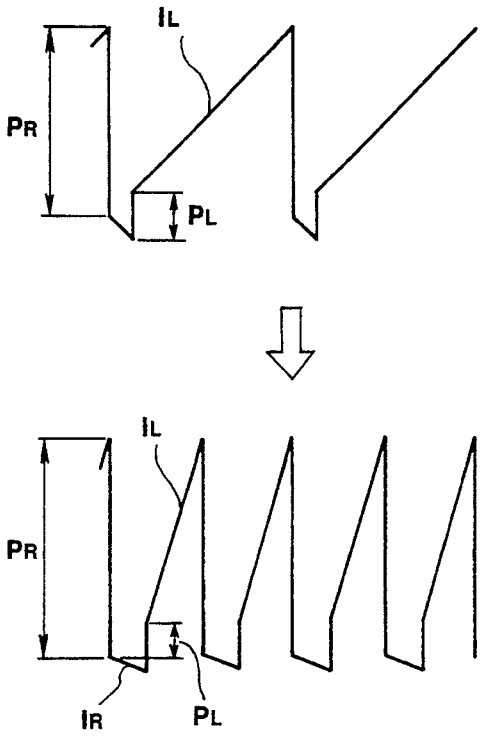
FIG. 6 PRIOR ART
Figure 7:
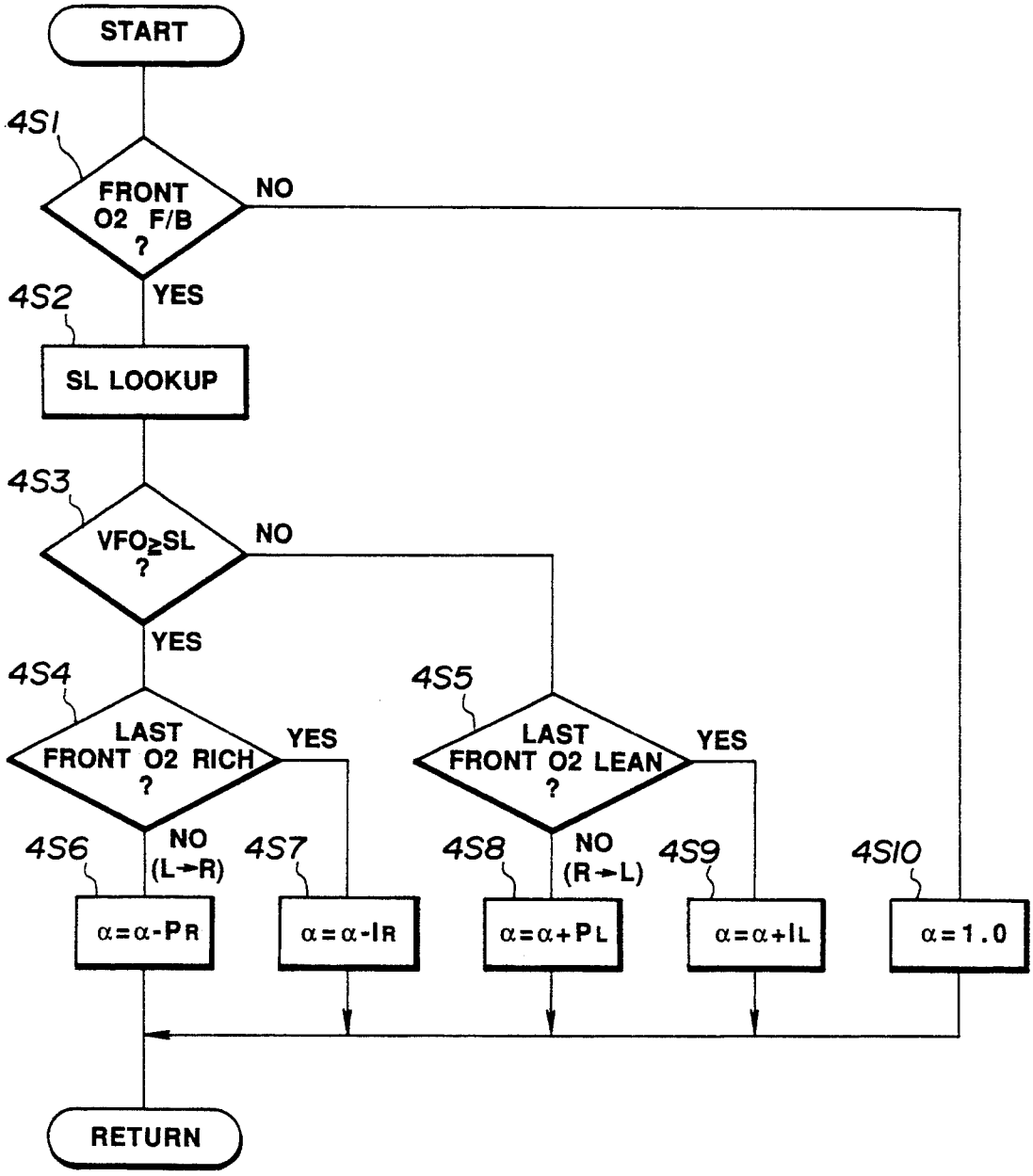
FIG. 7 PRIOR ART
FIGS. 7 and 8 are flow charts which depict the characteristics operations which are performed by a second prior art control arrangement discussed in the opening paragraphs of the instant disclosure.
Figure 8:
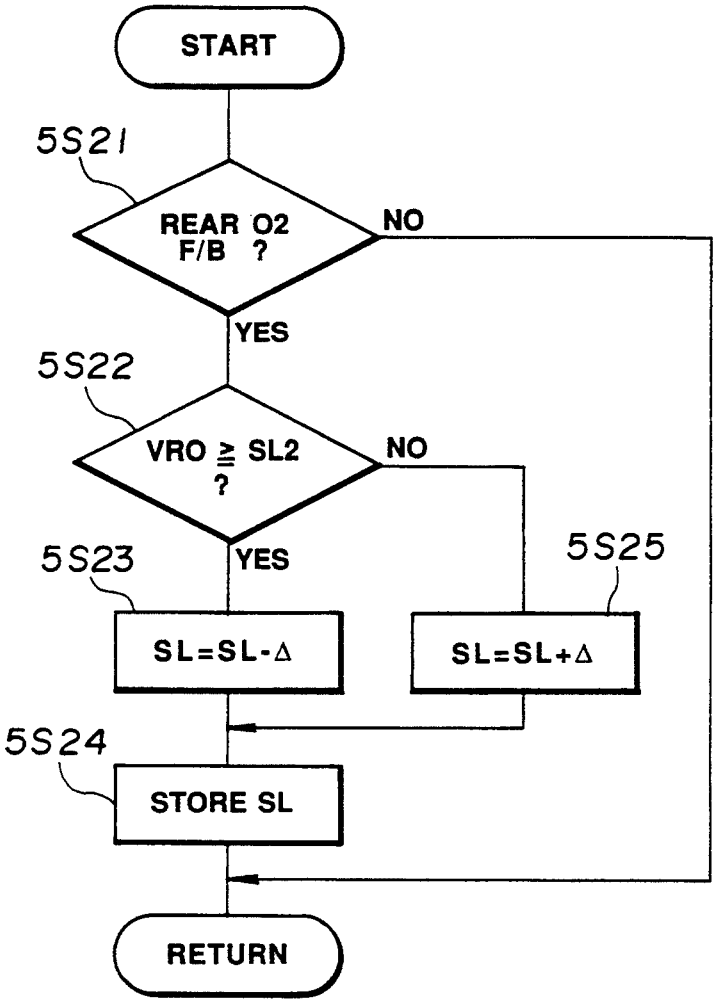
FIG. 8 (PRIOR ART)
Figure 9:
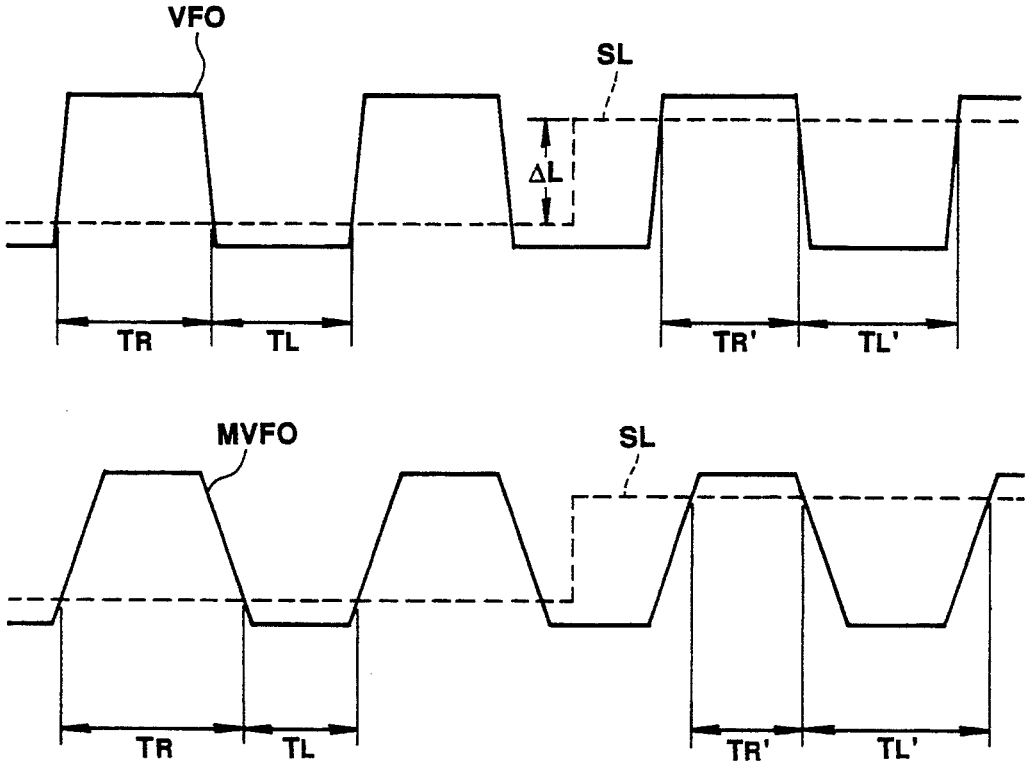
FIG. 9 PRIOR ART
FIG. 9 shows graphically the operational characteristics obtained with the second of the prior art arrangements.
Figure 10A:
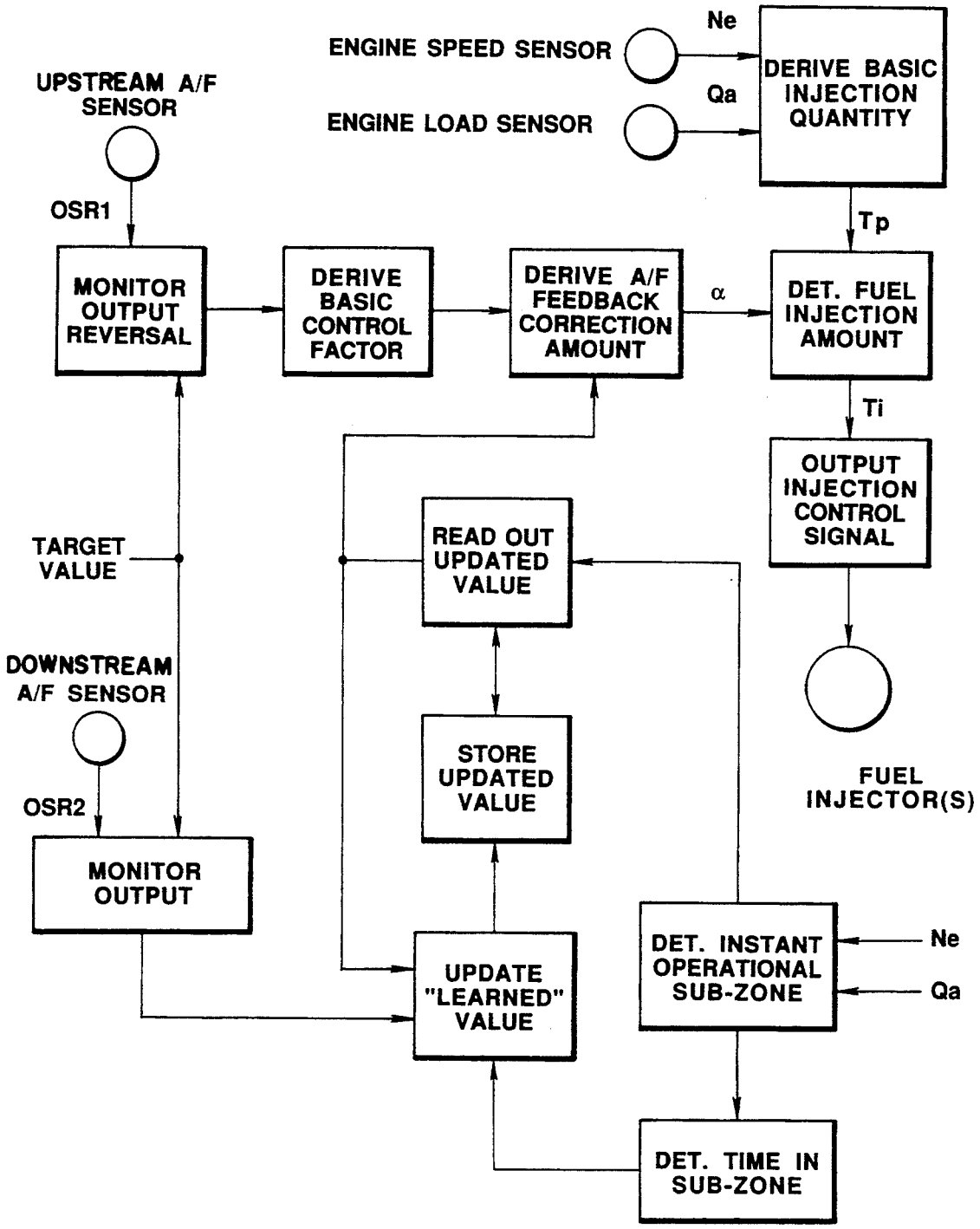
FIGS. 10A and 10B are functional block diagrams which outline the operations which characterize given embodiments of the present invention.
Figure 10B:
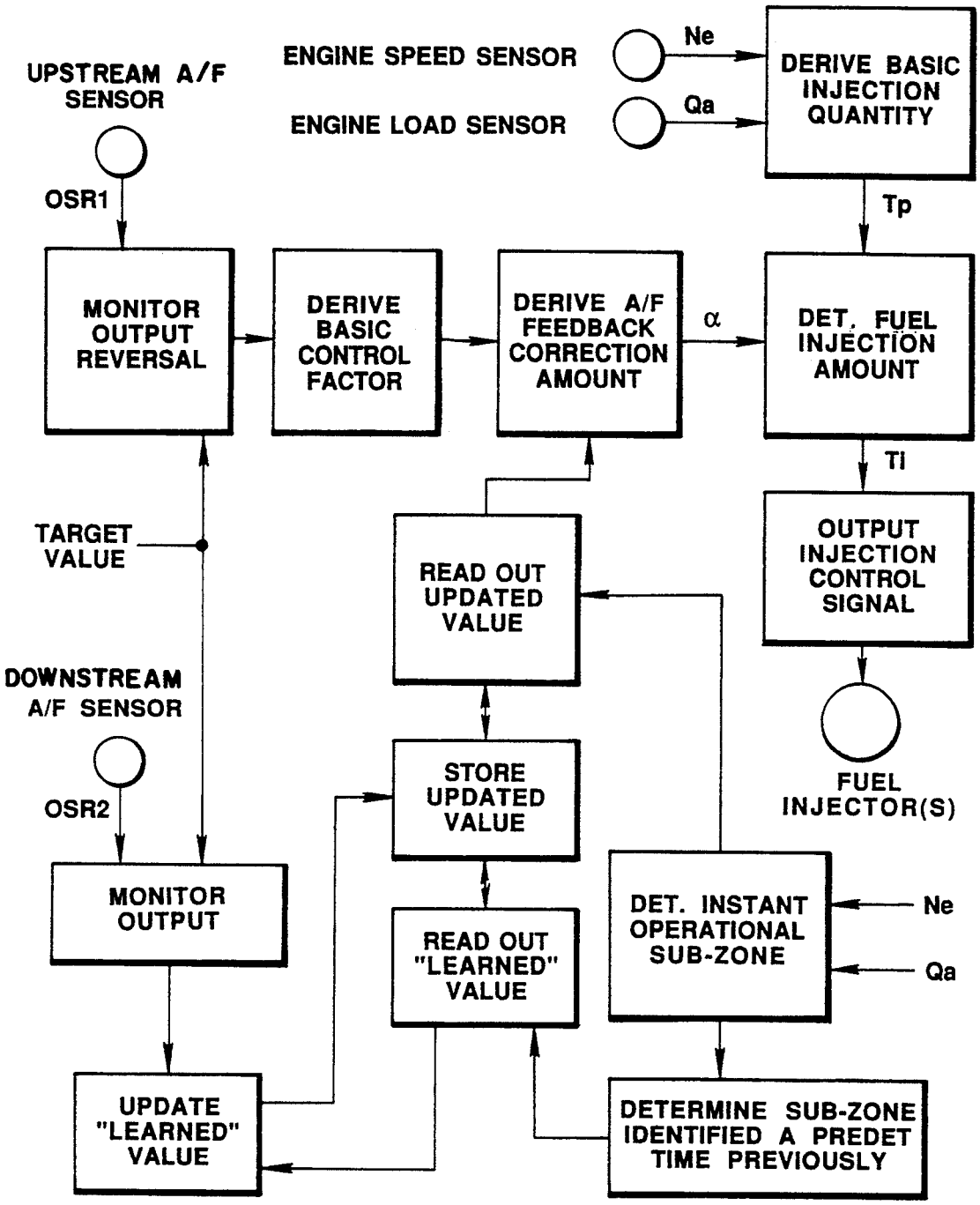

Once having obtained a corrected value a sub-routine of the nature previously disclosed in connection with FIG. 4 is used to derive the injection pulse width Ti.

FIG. 16 shows a routine which is used to update the LP value based on the output OSR2 of the downstream $O_2$ sensor. As indicated above this routine is run each time the output OSR1 of the upstream $O_2$ sensor exhibits a switch from one voltage level to another.

In this routine steps 2002–2005 and 2013 are such as to determined the amount of time the engine operation remains or dwells in any given operational sub-region.

At step 2002 a counter J which reflects the number of times OSR1 switches from one level to another, is incremented by one. Following this at step 2003 the instant engine speed and load values are read and used to determine which of the sub-regions the engine is currently operating. If the instant sub-region is the same as that determined on the last run (step 2004) the routine goes to step 2005 wherein the current J count is compared with a predetermined number n (e.g. 5) In the event that J>n it is deemed that the operating conditions have remained in the same region for a predetermined period and the routine is thus permitted to proceed to step 2006.

In the event that the outcome of step 2004 is such as to indicate that the instant sub-region is not the same as that nominated in the last run, the routine goes across to step 3013 wherein the counter is cleared.

The reason the operating conditions should remain in the same sub-region for more than a predetermined time before updating can be performed is to eliminate error which tends to result from the marked fluctuations in the that the air induction and fuel injection which tend to upon a transition from one sub-region to another.

As it take a finite time for any correction in the fuel injection to take effect—that it to say, a time $\tau$ is required for the fuel to be injected, mixed with air, inducted into the combustion chamber(s) combusted, exhausted and reach the upstream $O_2$ sensor. For this reason it is necessary to be able to determine the operational sub-region the engine was operating in a time $\tau$ before.

It should also be noted that it is possible to use a predetermined number of engine rotations, an integrated value of the amount of inducted air or injected fuel, or a predetermined time lapse in lieu of the above mentioned number of sensor output reversals. For example, the J count represents a lapsed time time period when the routine of FIG. 15 is run at predetermined uniform time intervals, a number of rotations of the engine when the routine is run in synchronism with the engine rotation, and the integrated value of the amount of air inducted (or fuel injected) when the routine is run in response to a unit amount of air being inducted or a unit amount of fuel being supplied to the engine.

Steps 2006 and 2010 are such as to update the value of the "learned" value. Viz., at step 2006 the value of LP is obtained by looking up an appropriate memory address in response to the engine operation having remained within a given operational sub-region for a time $\tau$.

At step 2007 the output OSR2 of the downstream $O_2$ sensor is sampled and compared with the slice level corresponding to the stoichiometric air-fuel ratio. If the mixture is sensed as being on the rich side the routine goes to step 2008 wherein the "learned" LP value is updated in the following manner:

$$LP = LP - DLPL \quad (6)$$

where DLPL is a constant.

The reason for this subtraction is that if the routine goes to step 2009 in response to a rich detection, the air-fuel mixture should be leaned. In order to achieve this it is not necessary to change both of the PR and PL values and the required adjustment can be achieved by merely increasing PR or decreasing PL.

That is to say, although the value of PR used in step 1010 is increased and the value of PL used in step 1018 is decreased, the decrease in the PL value may increase the value of PR since the "learned" or updated value of LP is used in both of equations (4) and (5).

On the other hand, if the air-fuel mixture is sensed as being on the lean side then the routine flows to step 2011 wherein the "learned" value LP is updated as follows:

$$LP=LP+DLPL \quad (7)$$

At steps 2009 and 2012 the extend to which the "learned" values updated in steps 2008 and 2011 can increase and decrease are limited. This limiting facilitates the stabilization of the air-fuel ratio control.

At step 2010 the updated "learned" value is stored in memory at an address which corresponds to the instant sub-region in which the engine is operating.

OPERATION OF FIRST EMBODIMENT

Figure 19:
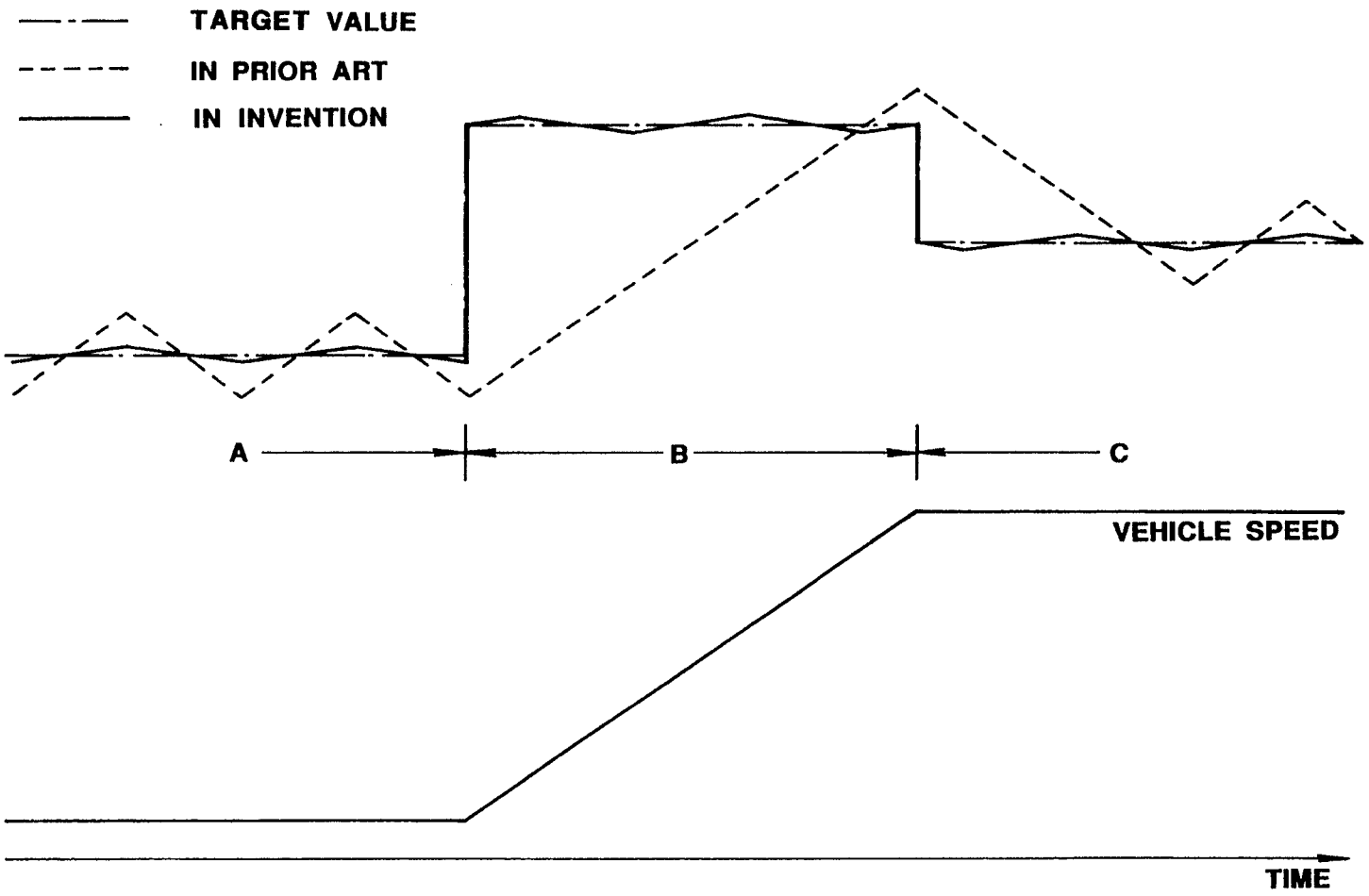
FIG. 19 is a timing chart which compares the operational characteristics achieved with the present invention, with those of the prior art.

FIG. 19 compares the operation of the present invention with a prior art arrangement during the time the vehicle operation shifts sequentially from sub-regions A, B and C.

In the case of a simple feedback control arrangement which does not have a self-updating or "learning" function, the rate of change of the correction factor Œ increases to permit the same to follow the changes in vehicle speed. The trace of the LP equivalent for this type of control is shown in broken line. Although this type of control can follow the change of speed during transient modes of operation, it will be noted that the trace is inclined and when the inclination is increased the tendency for the hunting to occur increases. The reason for this is that the inclination continues to occur under steady state mode of operation.

On the other hand with the first embodiment of the present invention, different LP values are recorded for each sub-region. Accordingly, when the mode of operation changes from one sub-region to another, the LP value for the new sub-region is read out. While the operation remains in the same sub-region the LP value remains constant. Accordingly, the LP trace for the invention changes in the illustrated stepwise manner. As the LP value is used in connection with the derivation of the proportional components PR, PL the correction of the same is executed in a manner which induces a corresponding stepwise change in the value thereof.

Accordingly, even though the LP value is derived based on the output of the downstream $O_2$ sensor (which exhibits a slow response) there is no delay in the correction of the PR, PL values. Further, as the response delay time $\tau$ is taken into account the accuracy of the learning or updating process is assured.

Hence, as will be appreciated the present invention renders it possible to implement fine air-fuel ratio error correction instantly upon the mode of operation shifting into a new operational sub-region, even through the delay in downstream $O_2$ sensor is substantial.

It will be noted that the learning or updating frequency is high during steady state operating conditions thus reducing the amount of change which occurs each update. This of course increases the fineness with which feedback control is achieved.

It should be further noted that the as the LP value is updated each time the OSR1 signal switches values, the air-fuel ratio feedback control based on the output of the upstream $O_2$ sensor can be matched with the learning control based on the output of the downstream $O_2$ sensor. That is to say, when the upstream $O_2$ sensor reverses the gases to which it is exposed have resulted from the combustion of a mixture which has an A/F close to the stoichiometric ratio. Accordingly, very shortly thereafter, the downstream $O_2$ sensor will be exposed to the same near/very near stoichiometric mixture.

Thus, by triggering a update in response to a change or reversal in the OSR1 it is possible to time the output of the downstream $O_2$ sensor is used in a manner which enables more accurate feedback control of the air-fuel mixture. This in turn leads to the air-fuel mixture being controlled closer to the stoichiometric ratio and the output of the upstream $O_2$ sensor being induced to reverse more frequently. This enables the accuracy of the feedback control be be further enhanced.

SECOND EMBODIMENT

FIGS. 20 & 21, 22 & 23 and 24 & 25 show second, third and fourth embodiments of the invention. While the first embodiment was based on the of the "learned" or updated values LP fo the modification of the proportional components PL, PR, the second–fourth embodiments are respectively based on the modification of the integrated components, the delay time and the slice level.

Figure 20:
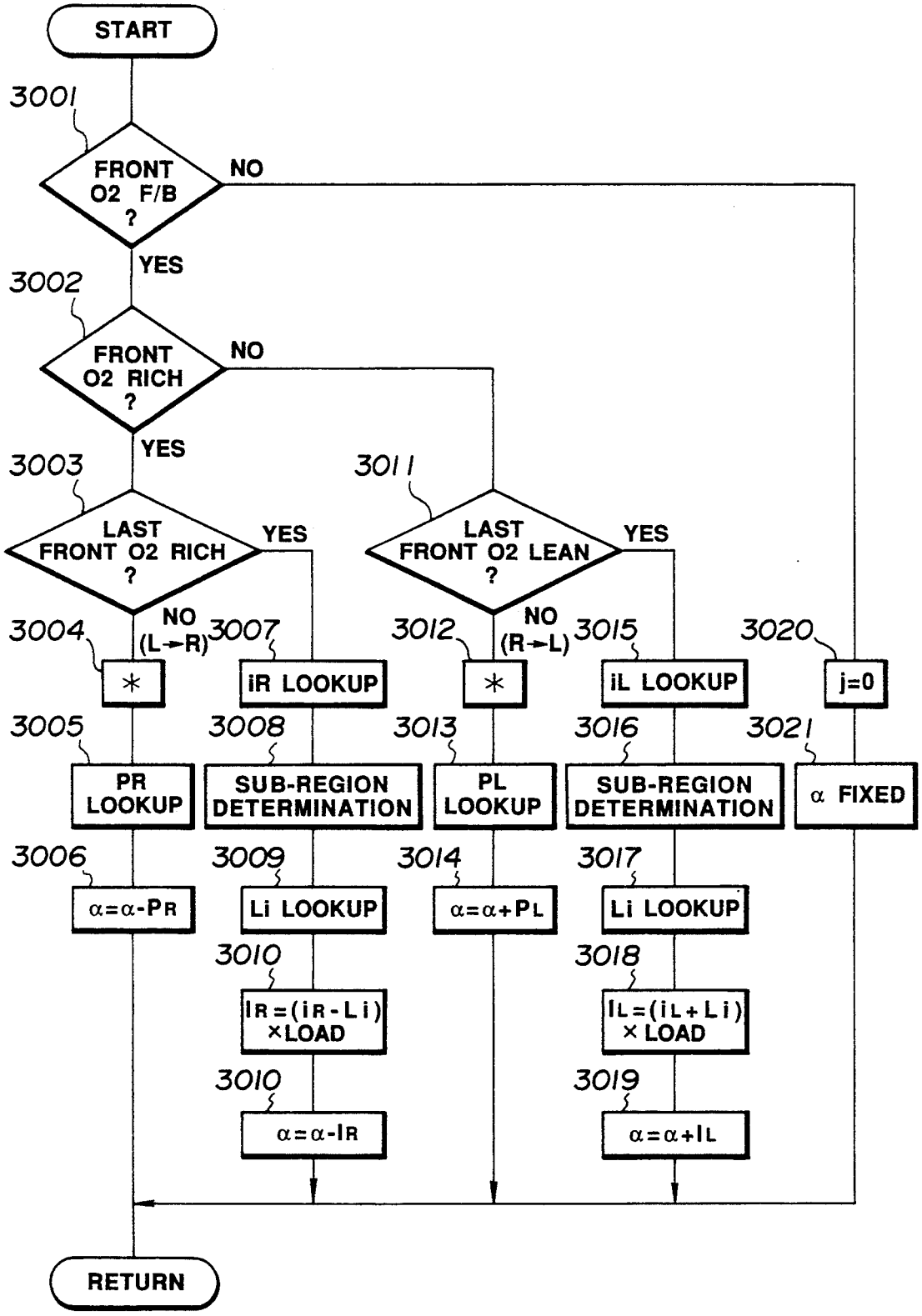
FIGS. 20 to 25 are flow charts which depict the operation which characterizes second, third and fourth embodiments of the present invention.

The flow chart shown in FIG. 20 (second embodiment) is basically similar to that of FIG. 15 and will be for the most part self-explanatory. It will be noted that at steps 3004 and 3017 that a "learned" or updated value Li is obtained by look-up by accessing the addresses of mapped data which correspond to the instant sub-region. Viz., the same situation as shown in FIGS. 17 and 18 only wherein the LP values are replaced with Li ones. Following these look-ups IR and IL values are calculated as follows:

$$IR=(iR-Li)\times \text{Load} \quad (8)$$

$$IL=(iL+Li)\times \text{Load} \quad (9)$$

These equations basically correspond to equations (2) and (3) but have the Li value further included therein.

THIRD EMBODIMENT

Figure 22:
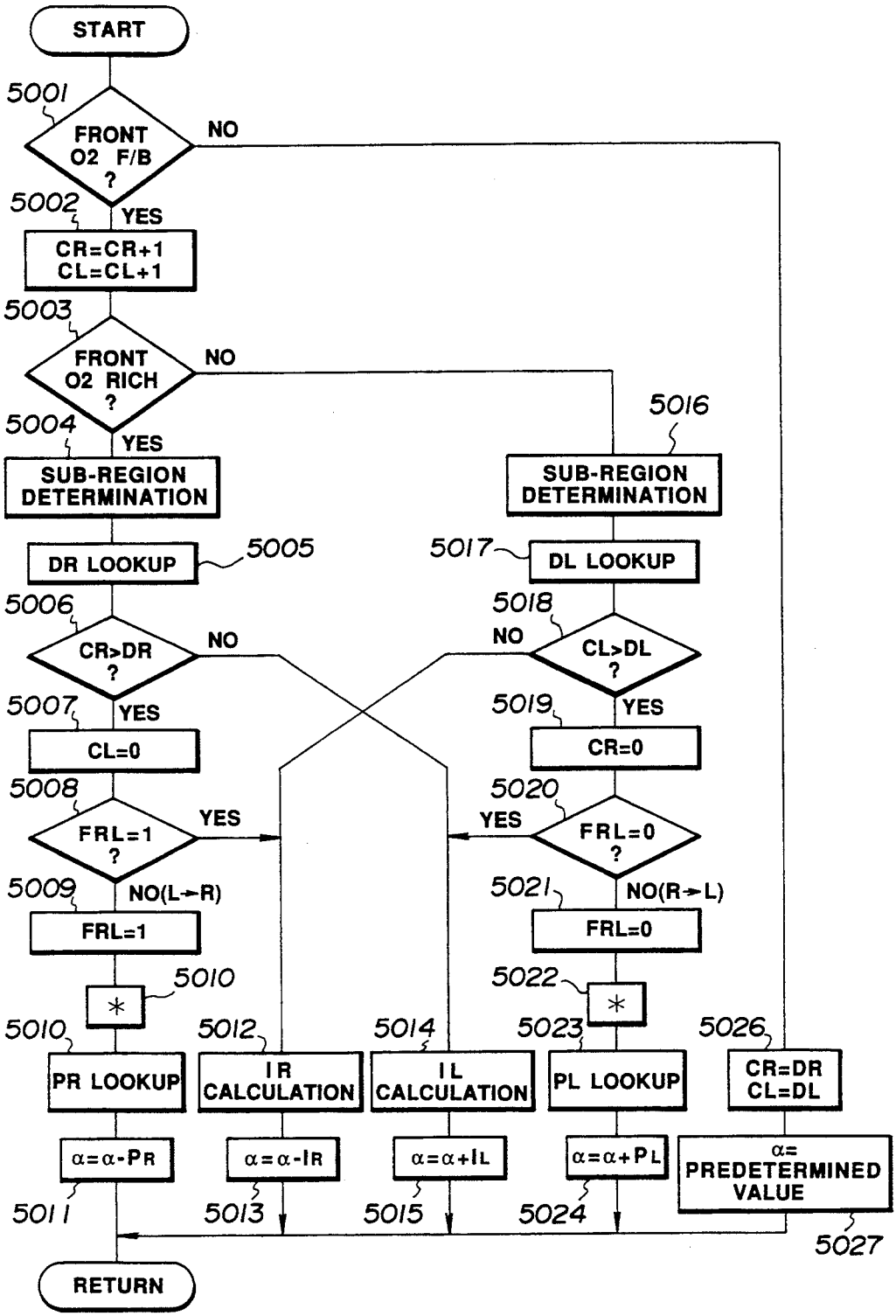

In steps 5005 and 5017 of the flow chart shown in FIG. 22 (third embodiment) "learned" values DR and DL which are related to the delay time are read from memory addresses which correspond to the instant operational sub-zone. At steps 5006 and 5008 the DR and DL values are compared with counts CR and CL which are incremented at step 5002 each time the program is run, and which represent the actual delay time, in order to determine if the CR and CD counts should be cleared and the OSR1 output of the upstream $O_2$ sensor checked at steps 5008 and 5020 for a reversal or not.

As will be appreciated, at steps 5008, 5009 & 5020, 5021, the flag FR=1 indicates that a switch from lean to rich has just taken place while FR=0 indicates a switch from rich to lean.

Figure 21:
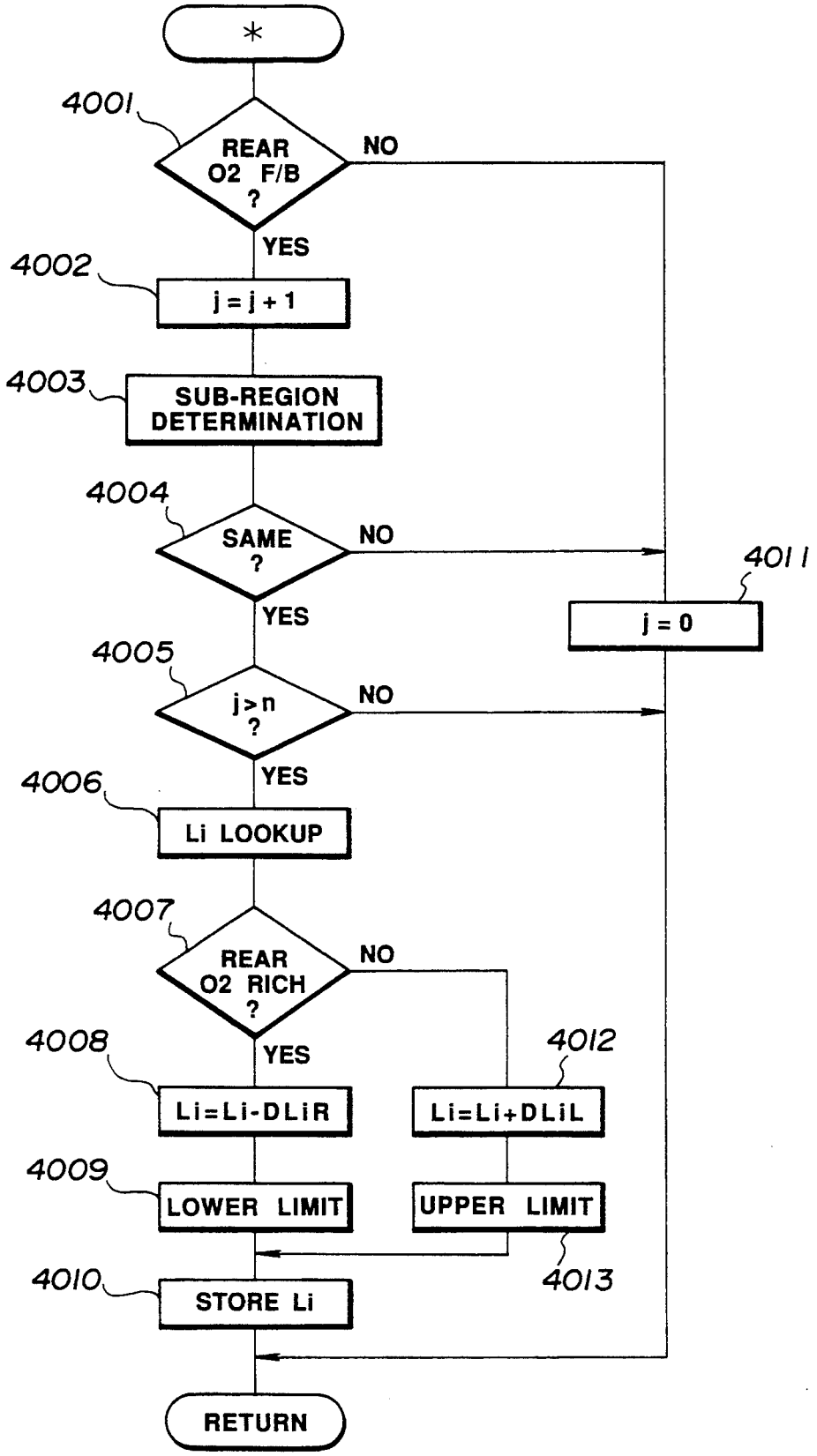
Figure 23:
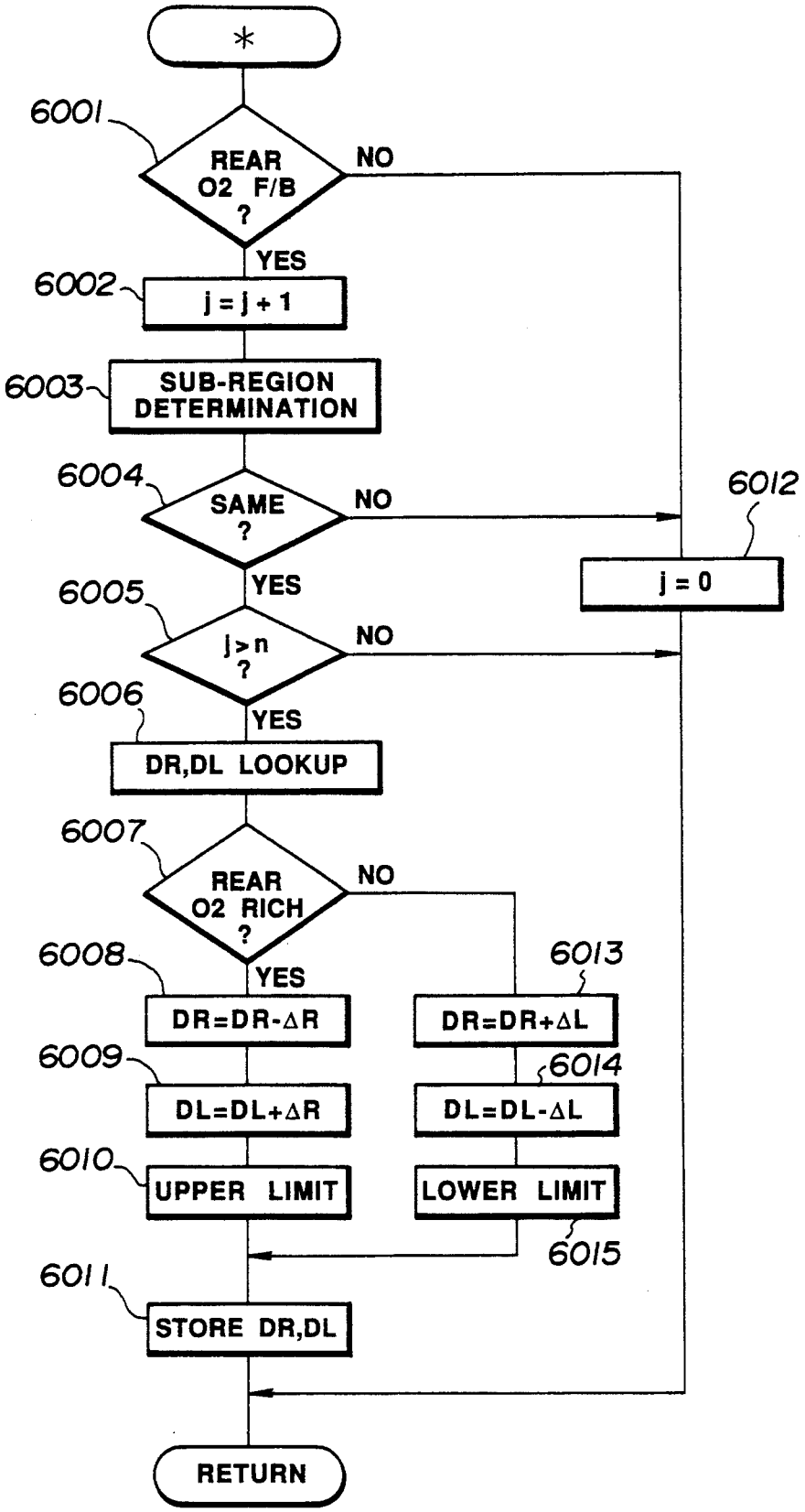

The operations performed in the routine depicted in FIG. 23 are deemed to be self-evident and in essence parallel those performed in the routine shown in FIG. 21 and therefore need no specific explanation.

FOURTH EMBODIMENT

Figure 24:
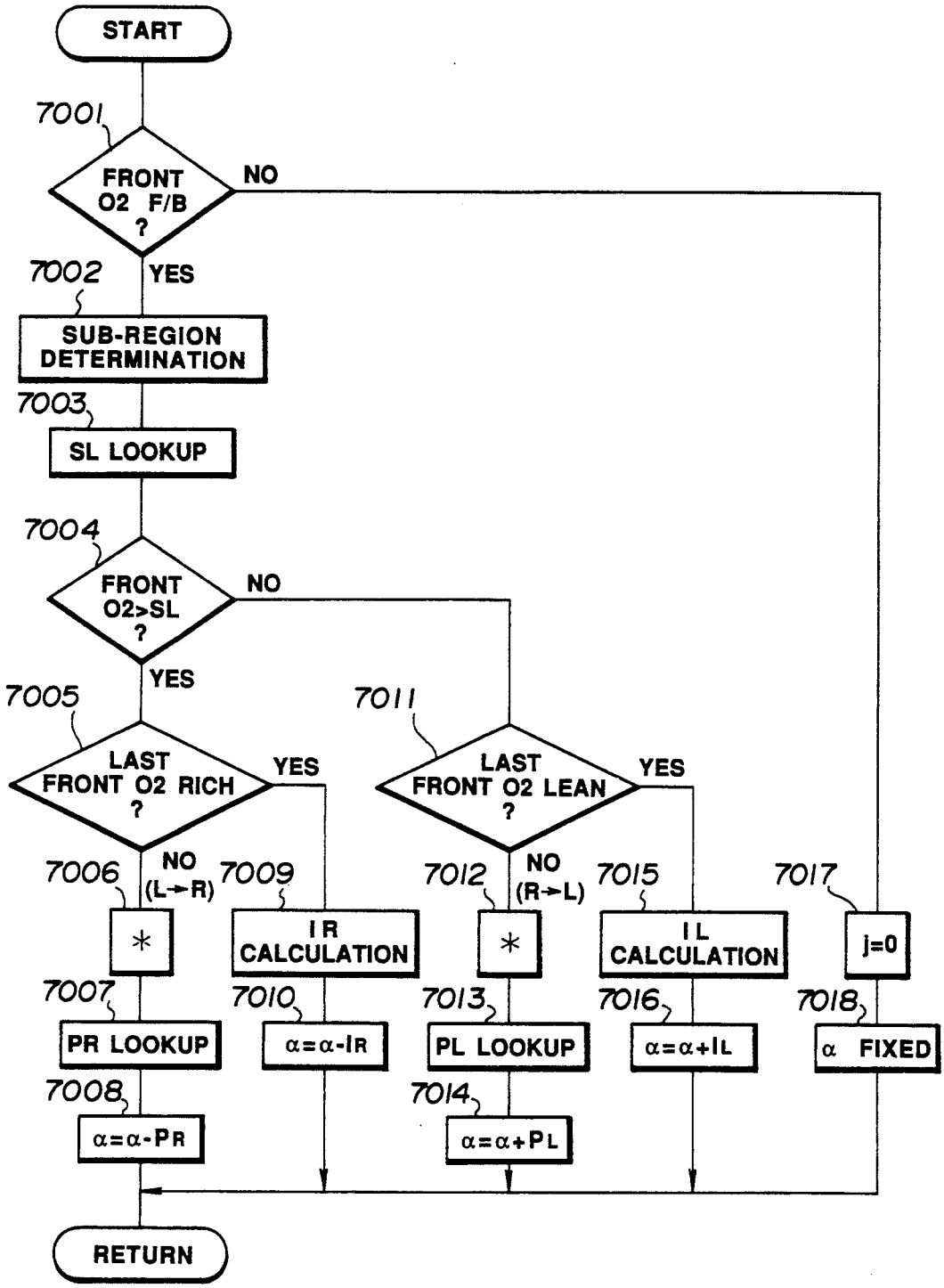
Figure 25:
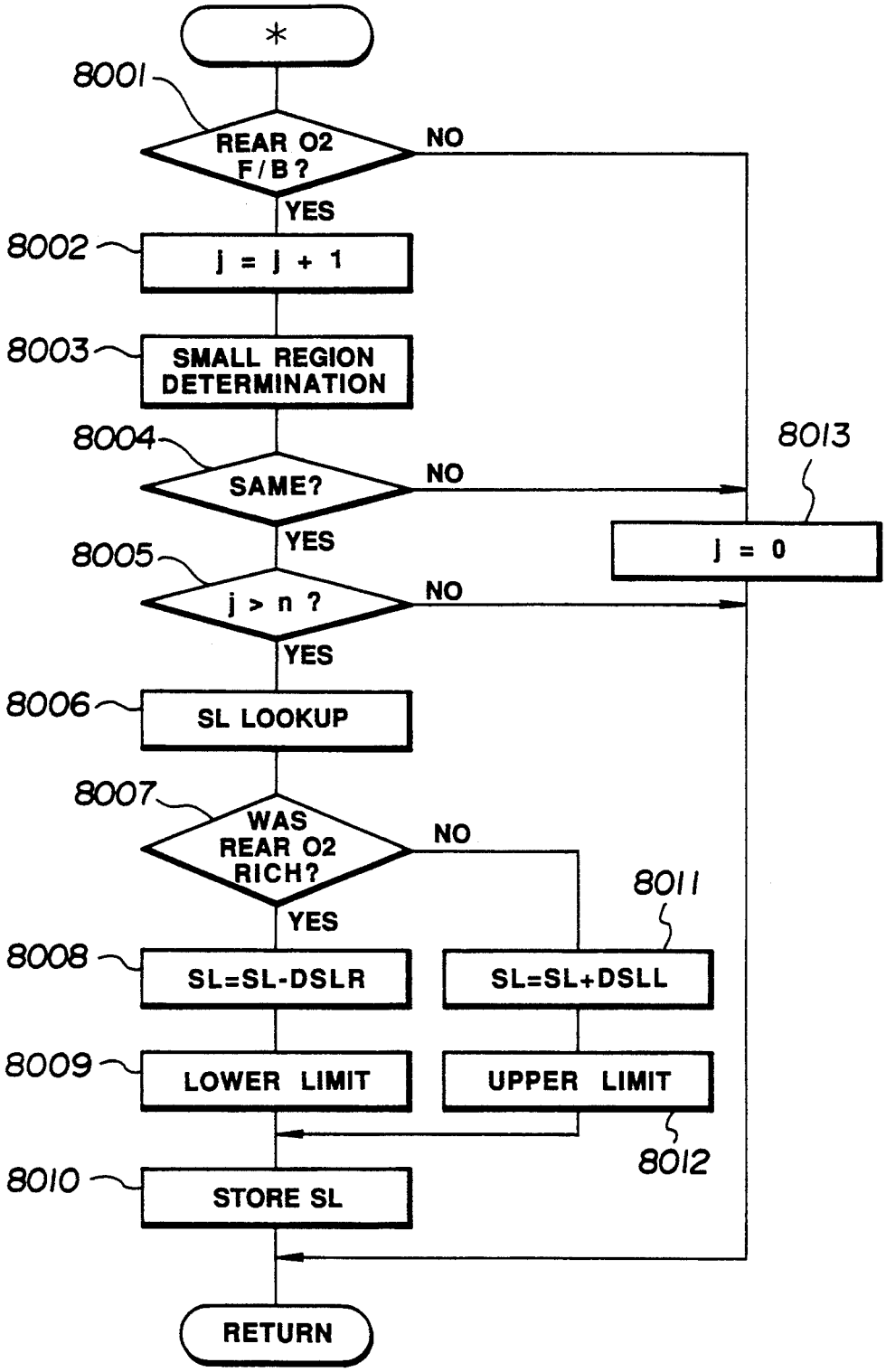

At step 7003 of the flow chart shown in FIG. 24, an updated slice level SL value is read out of from an address which corresponds to the instant operational sub-region and subsequently compared with the output OSR1 of the front or upstream $O_2$ sensor (step 7004) in order to determine if the mixture is rich or lean. It will be noted that the SL value may be derived in a manner which endows hysteresis characteristics thereon. Viz., as will be appreciated, at steps 8008 and 8011 of the routine depicted in FIG. 25, by suitably setting the decrement and increment values DSLR and DSLL, it is possible to have the slice level shift faster in one direction than the other.

FIFTH EMBODIMENT

Figure 26:
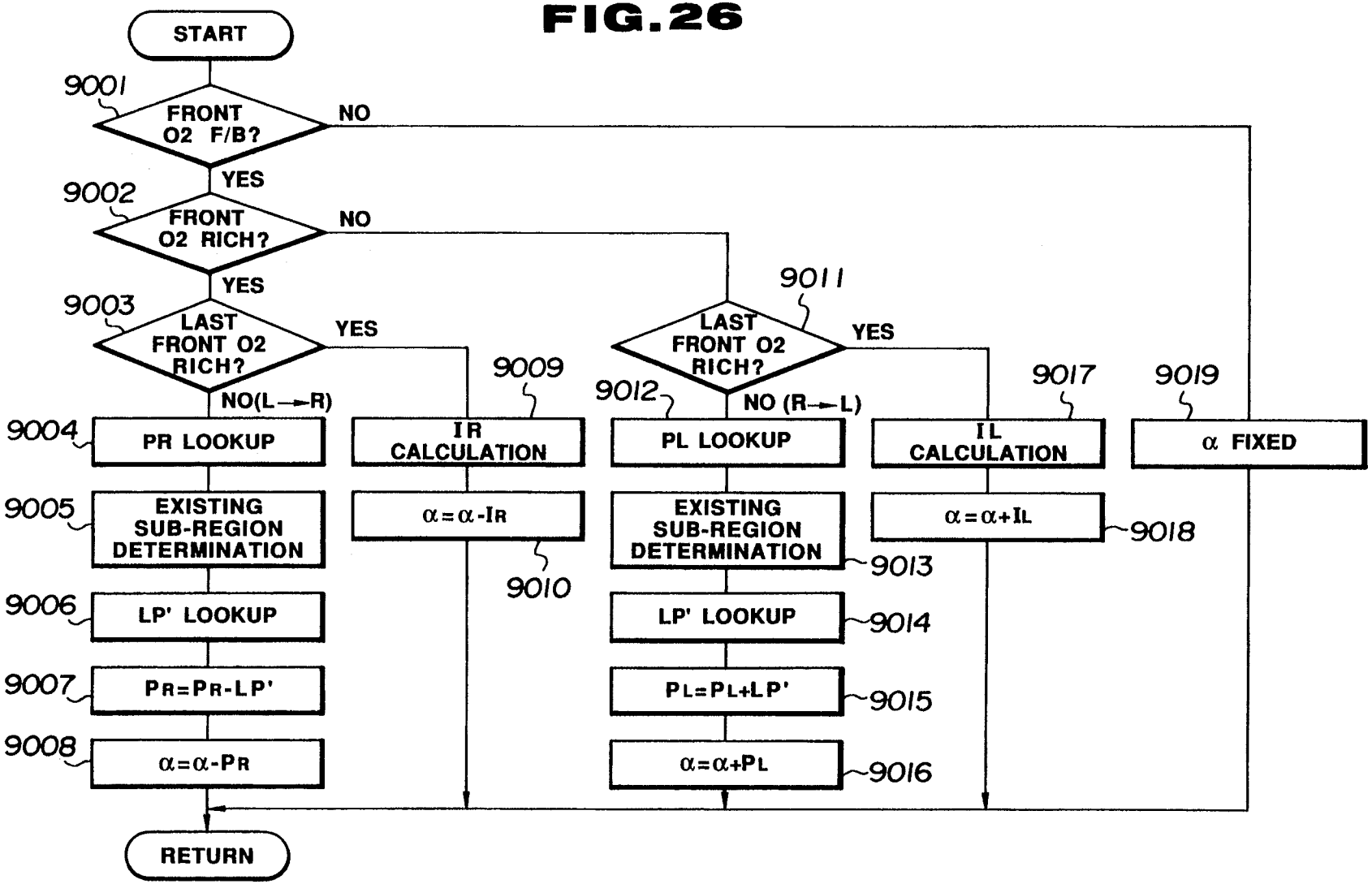
FIGS. 26–28 are flow charts which depict the operation of a fifth embodiment of the present invention.
Figure 27:
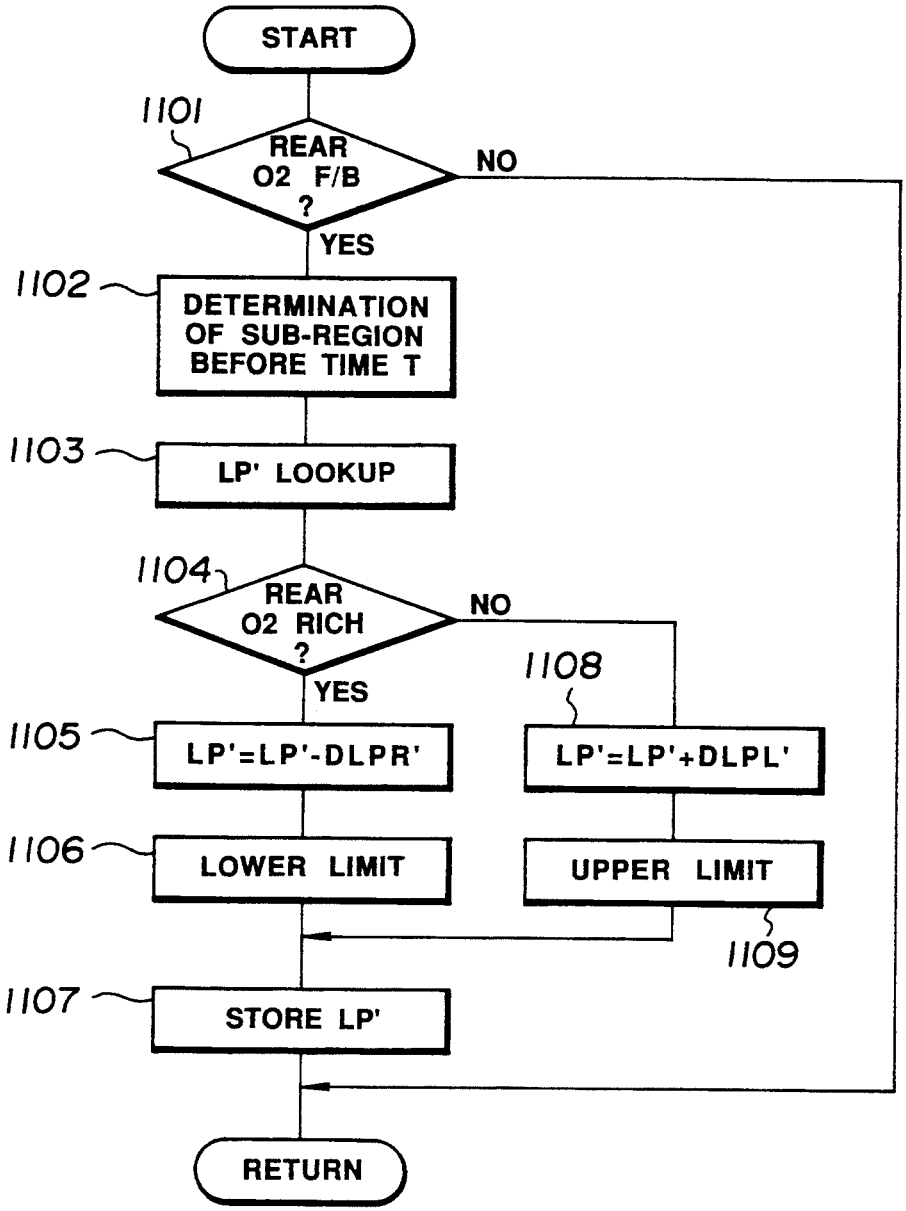

FIGS. 26 and 27 show flow charts which are basically parallel those shown in FIGS. 15 & 16 but which basically differ in that the updated values LP' which are stored as address which correspond to the sub-regions and which represent the operating conditions which existed a time $\tau$ before, are updated based on the instant OSR2 value.

In FIG. 26 steps 9005 and 901 3 are such as to determine which sub-region the engine operation currently falls in, while steps 9006 and 9014 are such as to read out the currently stored values from the appropriate memory addresses. Steps 9007, 9008, 9015 and 9016 derivation of the PR and PL values using the LP' value and calculation of the air-fuel ratio correction factor , are carried out.

In FIG. 27 the step 1102 determines based on inputs such as engine speed and load, which of the sub-regions the engine operation currently falls in. Following this the value of PL' which is currently stored at the memory address which corresponds to the instant operational sub-region is read out and depending on whether OSR2 indicates rich or lean the routine flows into the updating steps 1105 and 1108.

Figure 28:
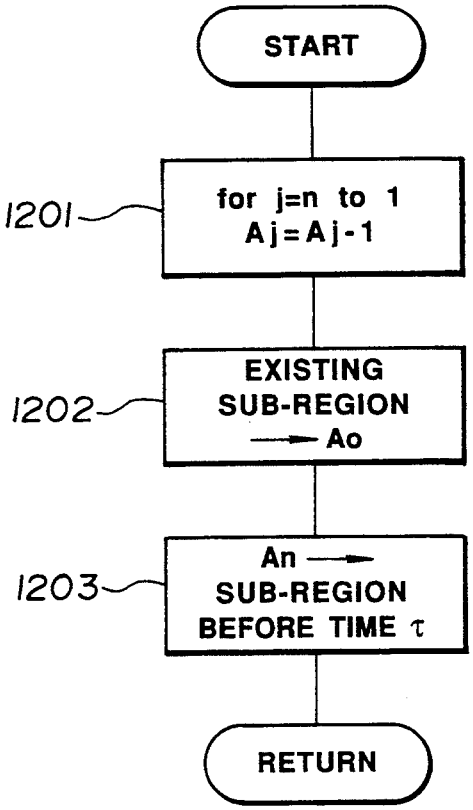
Figure 29:
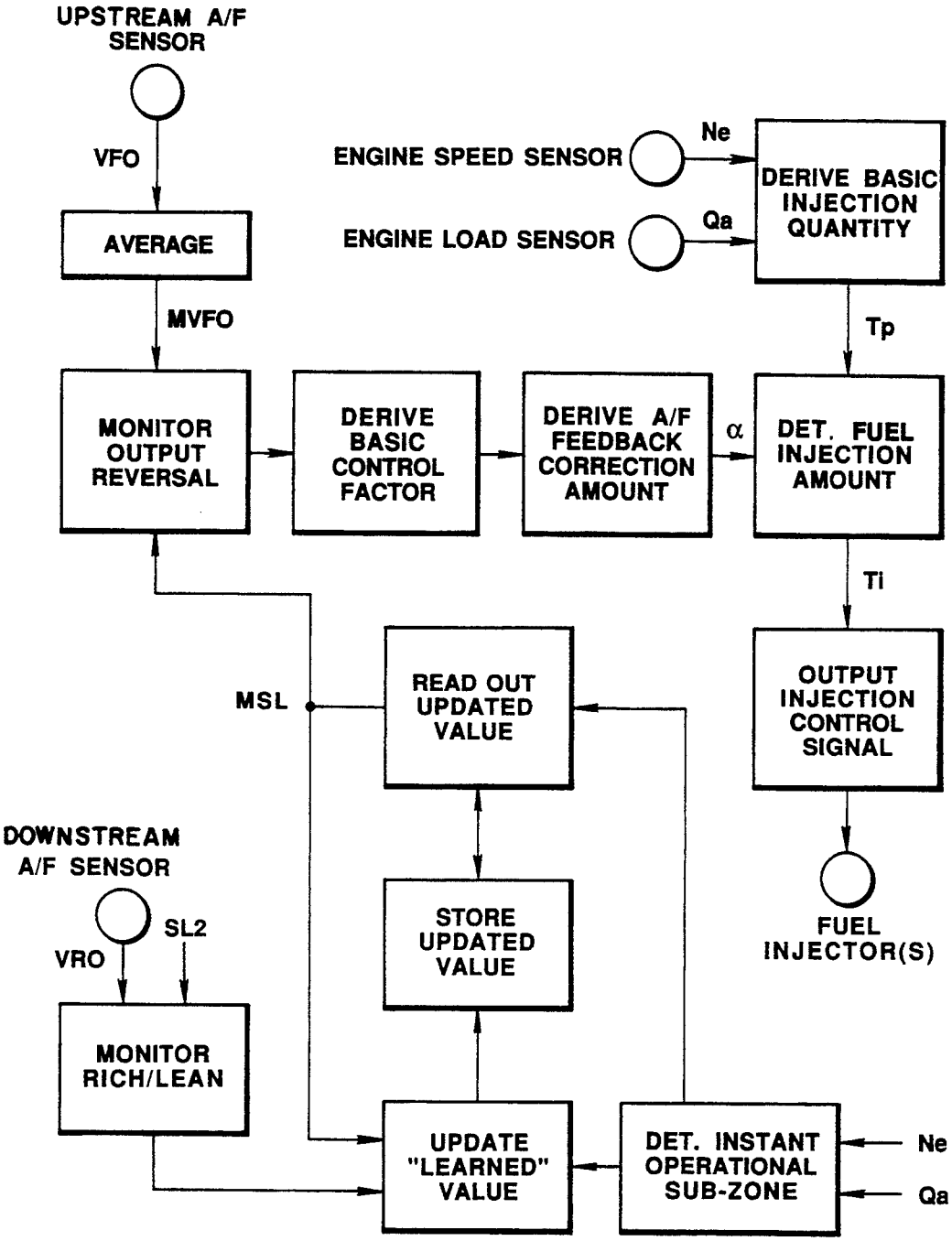
FIGS. 29 and 30 are functional block diagrams which outline the operations which characterize further embodiments of the present invention.
Figure 30:
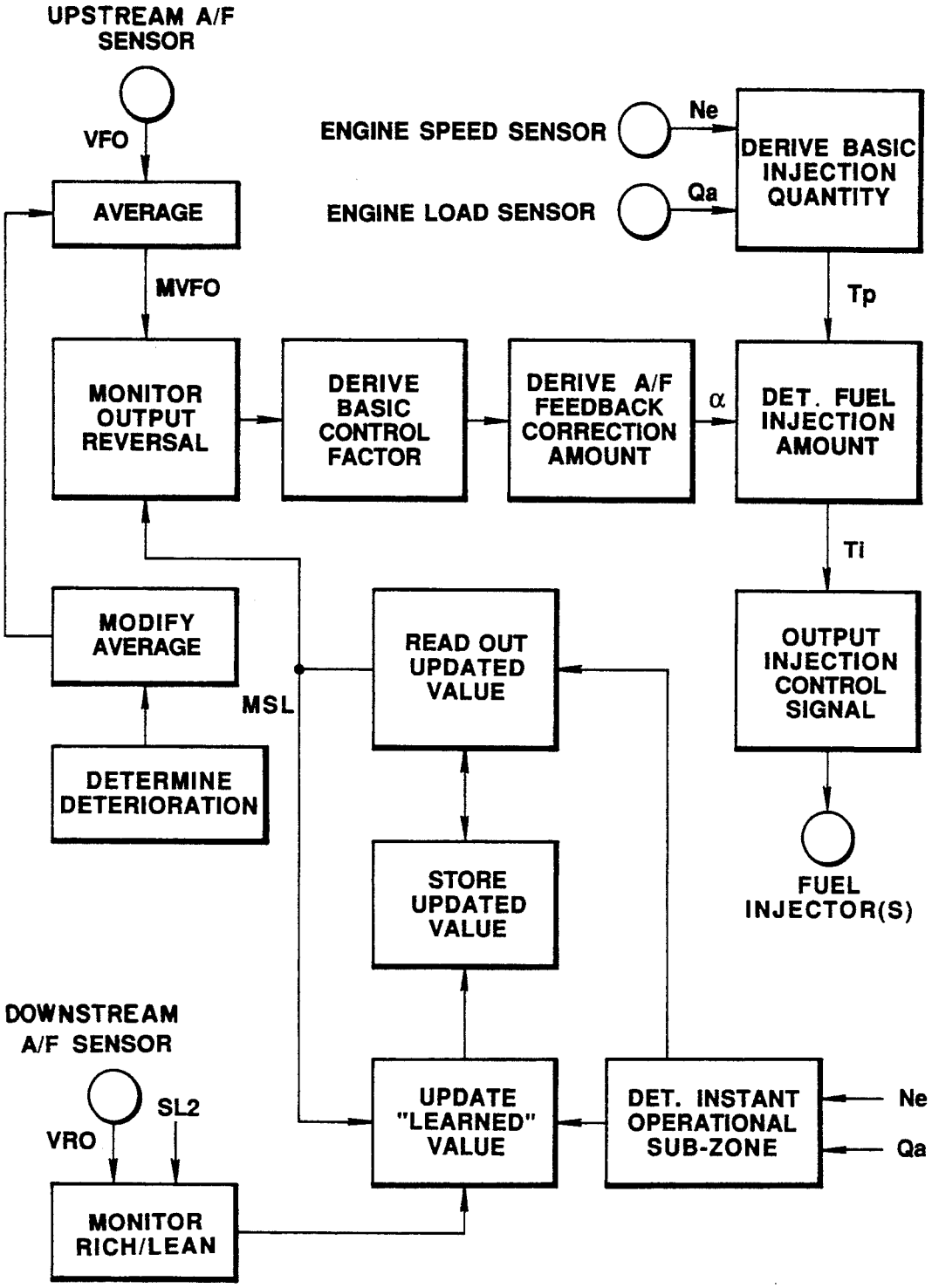

FIG. 28 shows a sub-routine via which is run in step 1102 in order to ascertain the sub-region the engine operation fell in a time $\tau$ previously. The running of this routine is synchronized with the engine rotation.

As shown, reference numerals are assigned to the sub-regions. A total of n+1 memory addresses A0, A1, . . . , Aj . . . , An are provided. At step 1201 the content of address Aj−1 which contains the reference numeral which identifies the sub-region used J−1 rotations previous, is shifted to the address Aj. This shifting is sequentially repeated from j=n (59 by way of example only) to J=1. The number of sub-regions into which operation fell is stored at address A0. In the event that n corresponds to time $\tau$, the number of sub-regions entered is stored at address An.

This feature obviates the need for the operational conditions to continuously fall in a given sub-region for a predetermined time and thus enables the "learned" value to be updated under steady state conditions. This enables the updating or learning frequency to be increased as compared with the previously disclosed embodiments.

SIXTH EMBODIMENT

Figure 31:
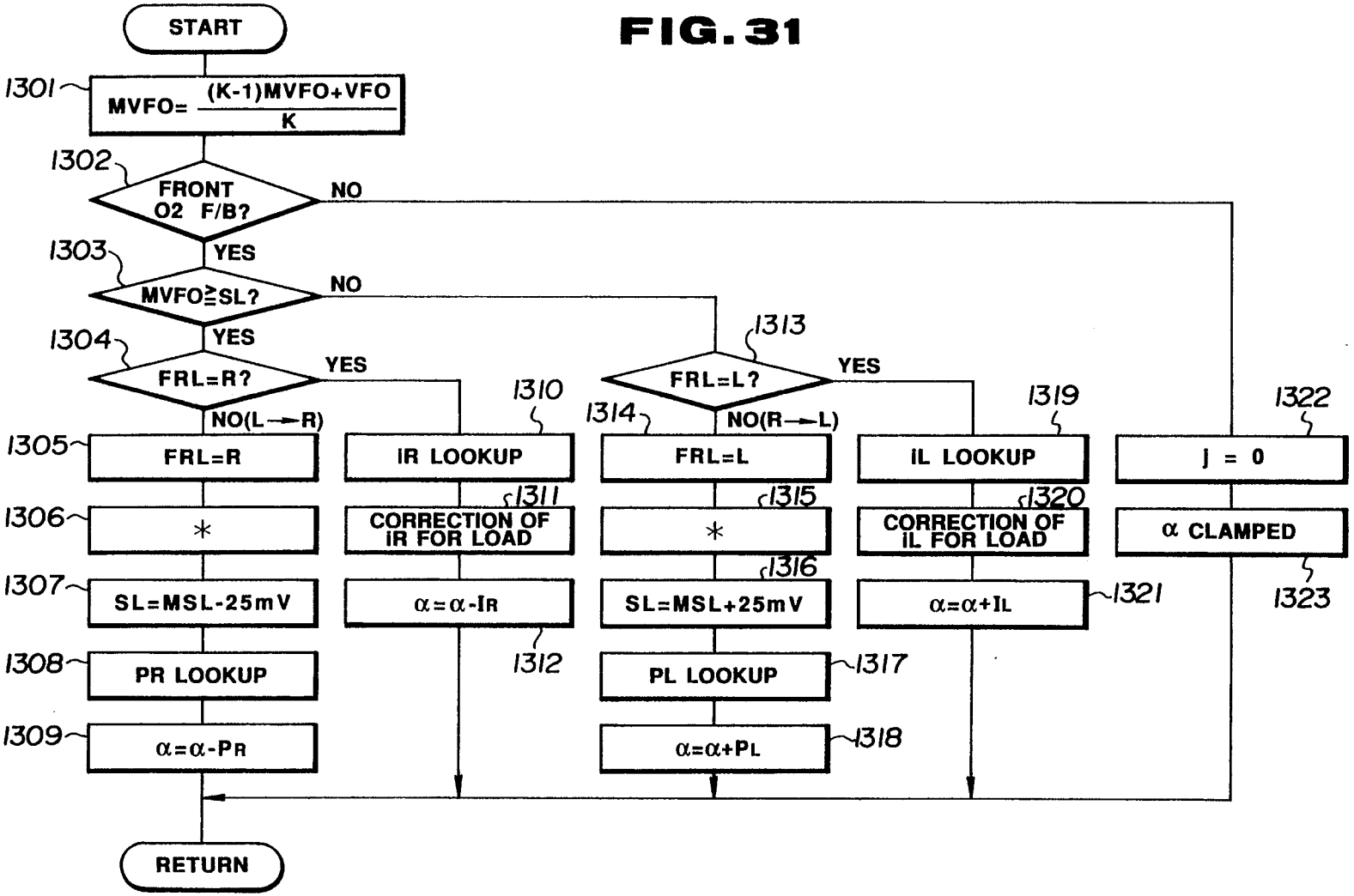
FIG. 31 and 32 are flow charts which depict the operation of a sixth embodiment of the present invention.

FIG. 31 show a routine which averages the output VFO of the front or upstream $O_2$ sensor and which performs air-fuel ratio feedback control based on the averaged value. This routine is run in synchronism with engine rotation.

The first step 1301 of this routine is such as to derive a weighted average MVFO of the output VFO of the upstream $O_2$ sensor. This is achieved using the following equation:

$$MVFO = \frac{(K-1)MVFO + VFO}{K} \quad (10)$$

where 1/K is a weighting factor which is constant and which is less than 1. The weighted averaging produces the same effect as a passing an electric signal through a filter. As the value of 1/K decreases (viz., the value of K increases the smoothing effect on the sensor output is increases.

At step 1302 it is determined if the upstream or front $O_2$ sensor is operating under conditions which permit the output VFO thereof to be accepted for feedback purposes. In the event that the above mentioned type of conditions which permit the usage prevail, the routine goes to step 1303 wherein the weighted average MFVO is compared with a slice level SL. Depending on the outcome of this comparison, the routine is guided to one of steps 1304 and 1313 wherein status of a flag FRL is checked.

On the last run of the routine if the flag was set FRL=R (step 1305) and in this case the outcome of the comparison conducted in step 1303 indicates the mixture is lean, then it is understood that output of the upstream $O_2$ sensor has switched from one voltage level to the other and the routine is guided into steps 1305–1309. If, on the other hand, on the last run of the routine FRL was set to R, and on this run is found to be still rich, the routine is guided into step 1310 to 1312.

In the event that the routine is guided to step 1313 then depending on the last setting of flag FRL the routine is directed to flow through steps 1314–1318 or 1319–1321. Again this this case it is possible by checking the FRL flag status to determine if the mixture has switched from rich to lean or has remain on the lean side.

Figure 32:
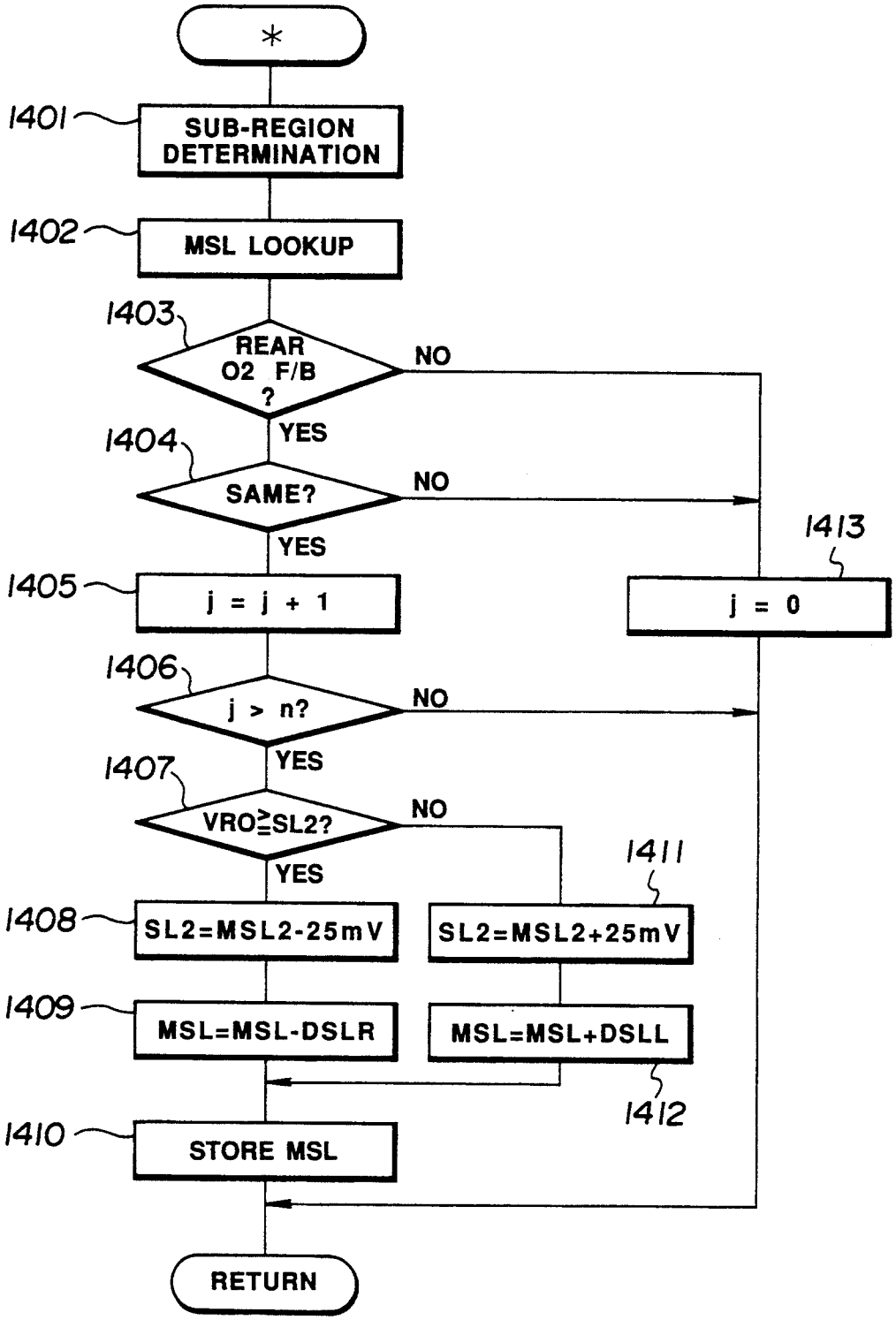

It will be noted that the *indication in steps 1306 and 1315 indicates in this case also that the update routine, in this case the routine shown in FIG. 32, is run as a sub-routine.

FIG. 32 shows the above mentioned update sub-routine. This routine is run each time the air-fuel mixture is sensed as having changed from rich to lean or vice versa. This routine is such as to update first and second "learned" slice levels MSL and SL2 in accordance with the output VRO of the downstream $O_2$ sensor. As will be appreciated the value of MSL is used in steps 1307 and 1316 to modify the level of the SL value with which the MVFO value is compared.

In step 1401 the instant operational sub-region is determined and in step 1402 the MSL value which is recorded at the memory address which corresponds to the instant sub-region is read out. In this embodiment, the sub-region data can be logged in terms of three parameters—engine speed, load and temperature.

Following this conditions under which the downstream $O_2$ sensor are operating and checked. If the appropriate conditions are found to be prevailing, the routine goes to step 1404 wherein it is determined if the sub-region determined in step 1401 on this run of the routine is the same as that determined on the previous run. In the event of an affirmative outcome, the routine goes to step 1405 wherein a counter j is induced to count up by 1. In step 1406 the instant J count is compared with a predetermined number n (wherein n=5 by way of example).

The reason for requiring the operation to fall in the same sub-region for a predetermined time (e.g. that required for 5 revolution of the engine) is the same as disclosed in connection with earlier described embodiments—it is necessary to wait for a time $\tau$ before the air-fuel mixture which results from the implementation of air-fuel correction, can reach the sensors. Therefore, it is necessary for the operation to fall in the same sub-region for a time $\tau$ to be sure that the control which is being implemented for that sub-region, is the cause of the air-fuel ratio being sensed and used for the updating of the slice level value which is recorded for said sub-region.

When the required number is reach the routine is permitted to flow to step 1407 wherein the output VRO of the downstream $O_2$ sensor is compared with a second slice level SL2 which is recorded with the value of MSL. Viz., at each of the addresses two slice levels MSL and SL2 are recorded. In the event that the predetermined number is reached indicating that the engine operation has remained continously in the same sur-region for a sufficient period of time, both of the slice levels are read out. SL2 is compared with VRO at step 1407 and in steps 1408, 1409 and 1411, 1412 both the slice levels are updated.

It will be noted that at steps 1408 and 1411 the slice level SL2 is hysterically modified according to the following equations:

$$SL2=MSL2-\Delta SL \quad (11)$$

$$SL2=MSL2+\Delta SL \quad (12)$$

It will be noted that MSL2 is a fixed slice level value (e.g. 500 mV) which is selected to be indicative of the stoichiometric ratio (target value) and ΔSL2 is used to determine the hysteresis and is set at 25 mV for example.

At step 1409 the slice level MSL is updated as follows:

$$MSL=MSL-DSLR \quad (13)$$

The reason why the DSLR value is subtracted is that the routine goes to step 1409 in response to a rich detection. Accordingly, the ratio H of the time for which the air-fuel ratio is rich and the time it is lean should be modified in a manner which shifts the A/F in the lean direction. To this end the slice level SL can be reduced.

On the other hand, if the air-fuel ratio is found to be on the lean side, the routine proceeds from step 1407 to step 1412 (via step 1411). In this step the learned slice level MSL is updated as follows:

$$MSL=MSL+DSLL \quad (14)$$

It will be noted that DSLR and DSLL are constants and normally DSLL≦DSLR.

At step 1410 the updated MSL value (along with the SL2 value) is stored at the address of the instant sub-region.

Returning to the main control routine shown in FIG. 31, it will be noted that at steps 1307 and 1316 the MSL value is used in a manner to provide the SL value which a degree of hysteresis. Viz., in these steps the slice level is set as follows:

$$SL=MSL-\Delta SL \quad (15)$$

$$SL=MSL+\Delta SL \quad (16)$$

By way of example, ΔSL is indicated in the flow chart of FIG. 31 as being 25 mV.

Steps 1308 to 1312 is such as to determined the feedback control factor . At steps 1308, 1310, 1317 and 1319 proportional and integrated components PR, PL & iR, iL are obtained by looking up tabled data. At steps 1311 and 1320 the iR and il values are corrected for load by multiplying the same with a load indicative value such as Ti (fuel injection pulse width). Viz.:

$$IR=iR\times Ti \quad (17)$$

$$IL=iL\times Ti \quad (18)$$

The value of Ti can be replace with other suitable load related values as per the case of the previously disclosed embodiments.

The reason for this type of load related correction is that amplitude of Œ is held constant irrespective of the control period and since the conversion efficiency of the catalytic converter decreases in response to an increase in the Œ fluctuation when the Œ control period is relatively long.

The remaining steps are deemed to be self-explanatory in light of the disclosure of the previous embodiments.

Figure 35:
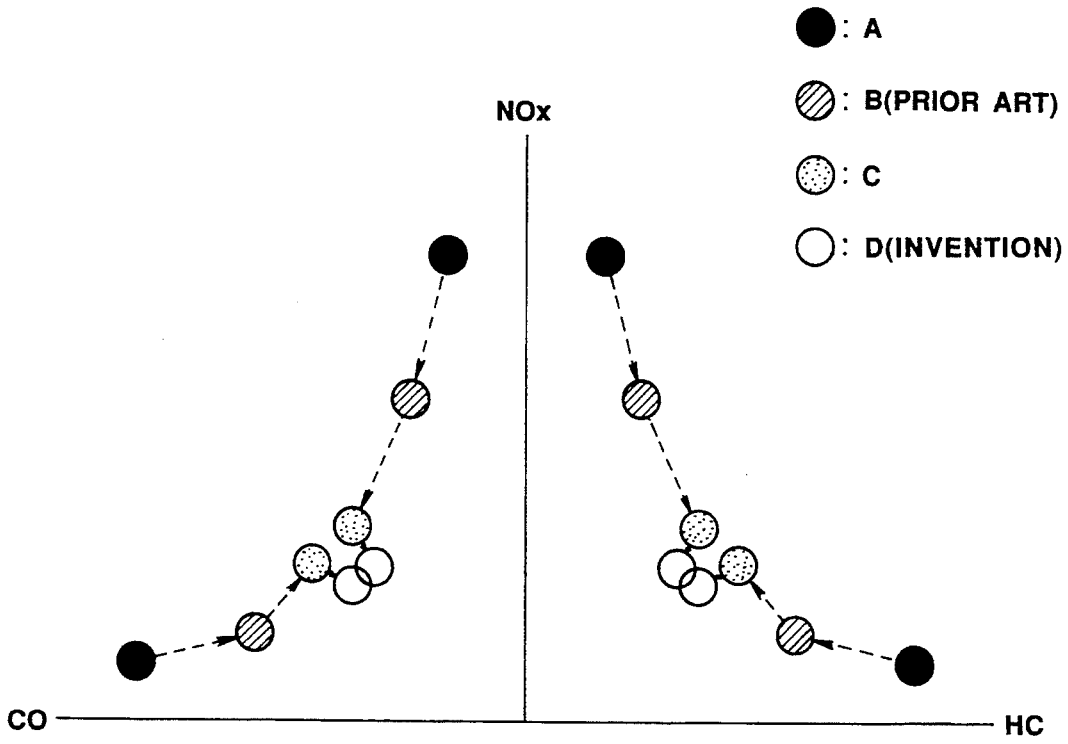
FIG. 35 is a graph comparing the exhaust emission characteristics of the present invention with the prior art.

FIG. 35 compares the emission level control which is possible with the present invention with a prior art arrangement wherein the learning or self-updating function is not included in the control routines. More specifically:

A denotes the case wherein no downstream sensor is used;

B denotes the case wherein the output of the upstream sensor is corrected at fixed time intervals in accordance with the output of the downstream sensor (disclosed prior art);

C denotes the case wherein the output of the upstream sensor is averaged; and

D denotes the case wherein the a learning function according to the present invention is included in the feedback correction control.

SEVENTH EMBODIMENT

Figure 36:
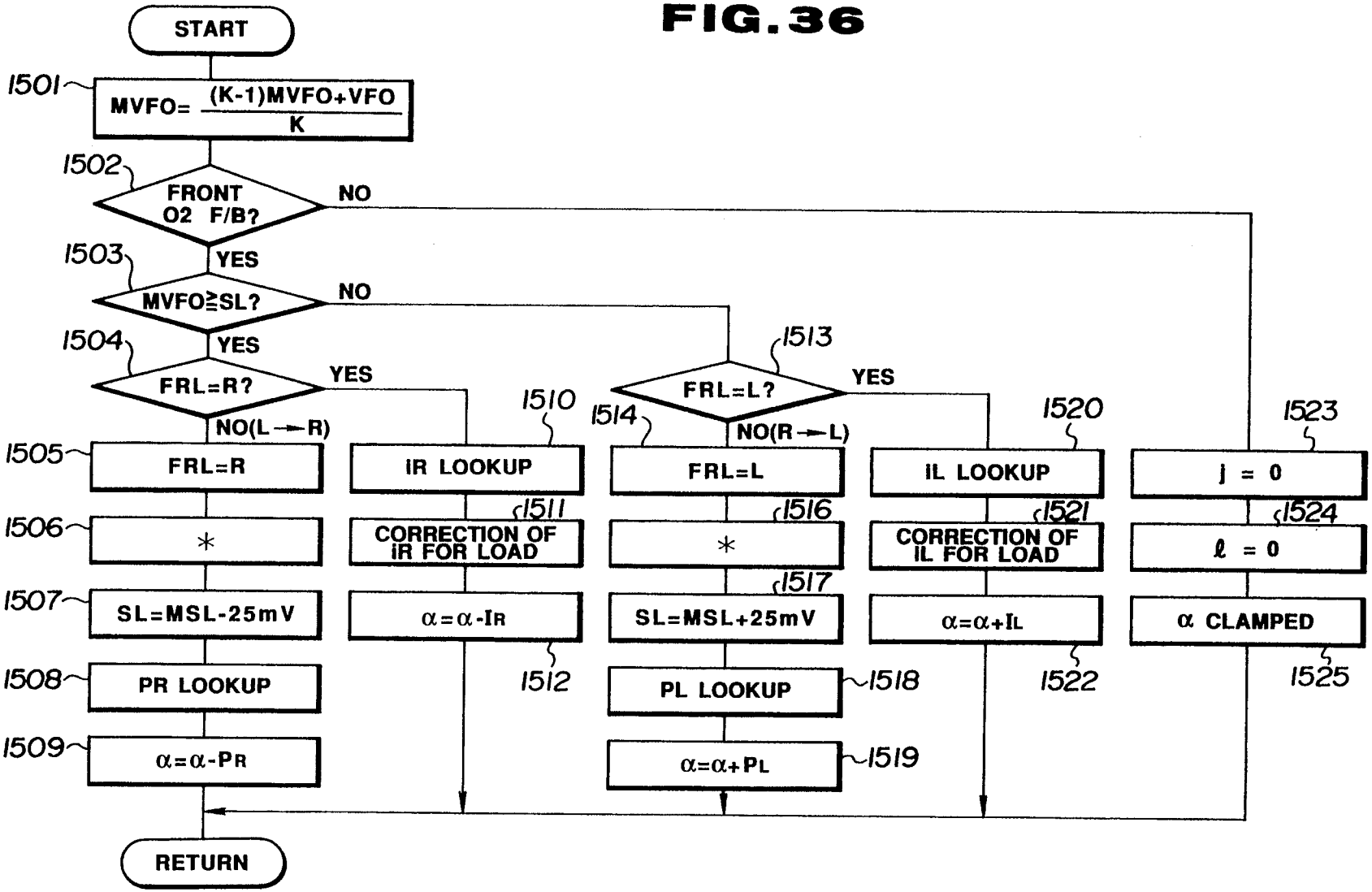
FIGS. 36 to 39 are flow charts which depict the operation of a seventh embodiment of the present invention.
Figure 39:
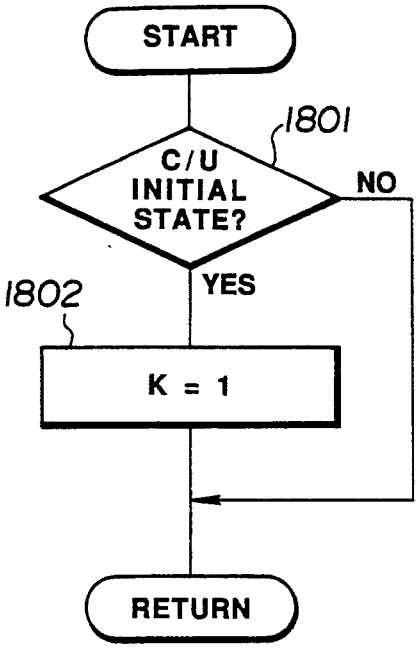
Figure 40:
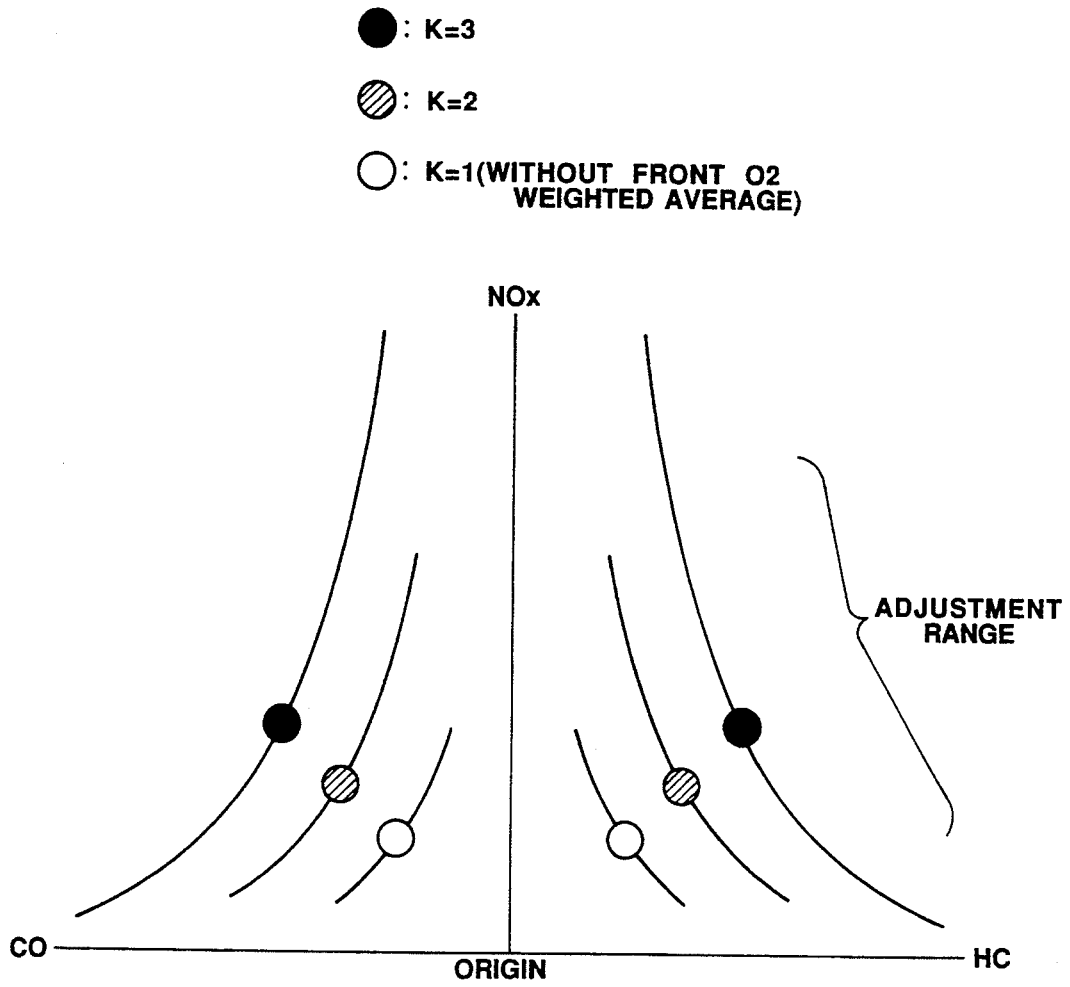
FIG. 40 is a graph similar in nature to that shown in FIG. 35 but which demonstrates the emission characteristics provided with the above mentioned seventh embodiment.

FIGS. 36 and 39 show routines which characterize a seventh embodiment of the present invention. In this embodiment the deterioration of the upstream $O_2$ sensor is taken into account.

Figure 37:
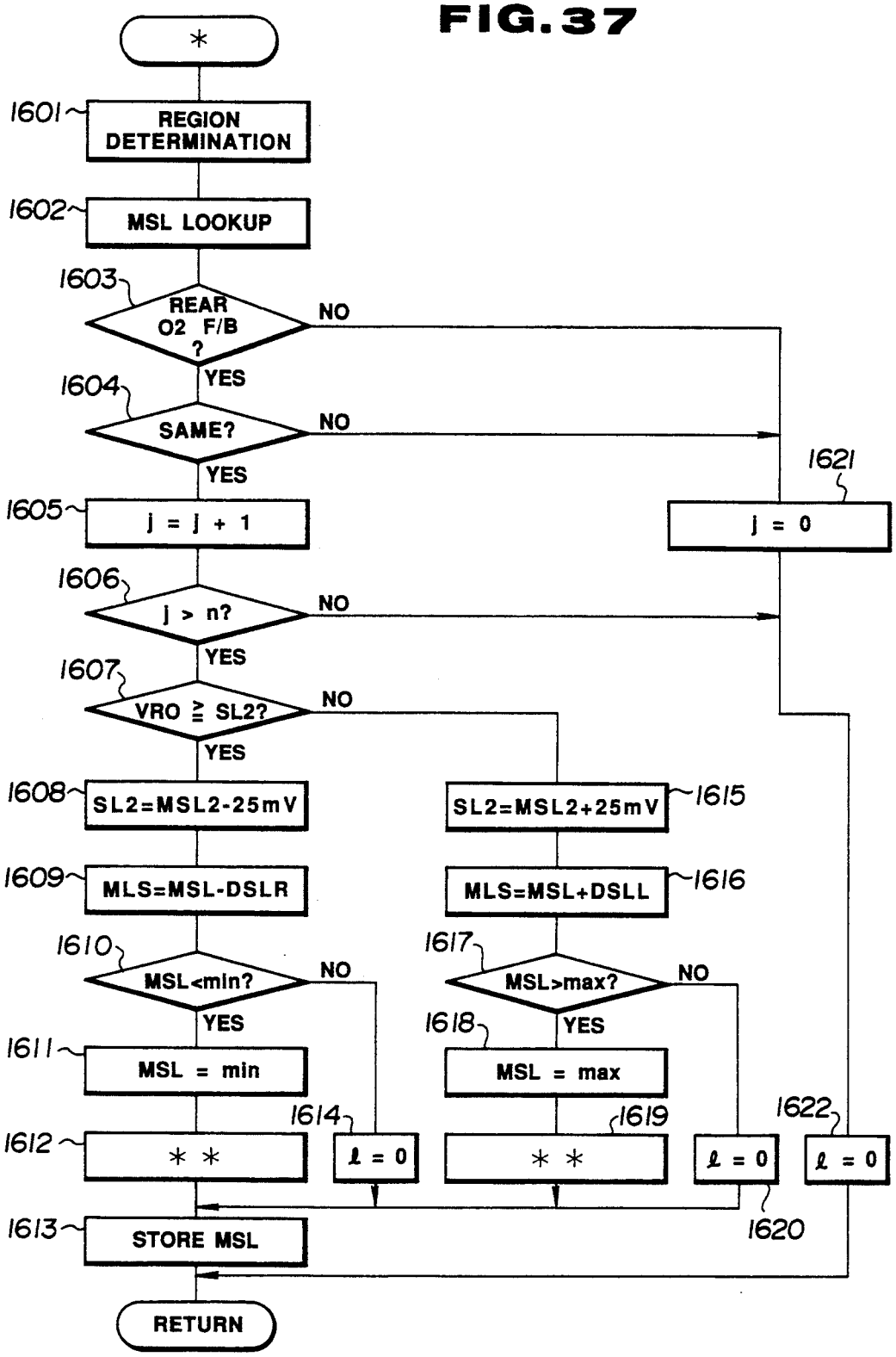

At steps 1610, 1611 & 1617, 1618 of the routine shown in FIG. 37 the "learned" MSL value which is updated in steps 1609 and 1616 is screen to determine if it above a maximum value or below a minimum one. In the event of affirmative outcomes, in steps 1611 and 1618 the instantly derived MSL values are limited to min and max values in order to stabilize the air-fuel ratio control.

Figure 38:
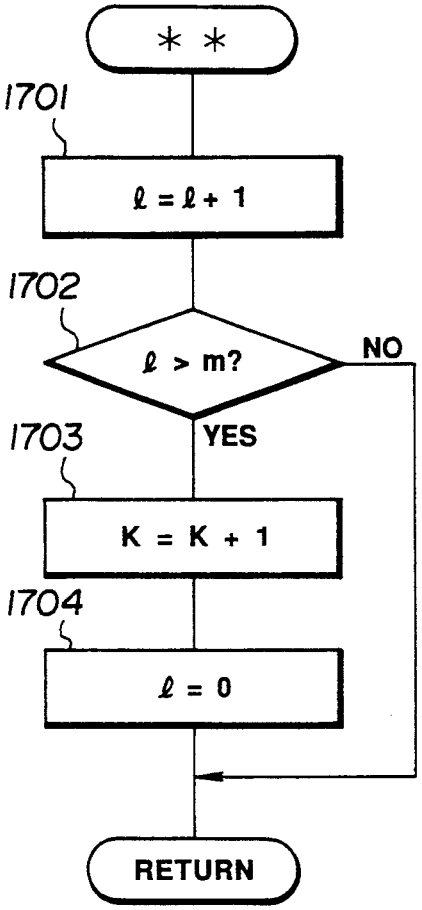

In response to the MSL value falling outside the max-min range, it is deemed that the upstream $O_2$ sensor is showing signs of deterioration and the at steps 1612 an 1619 the sub-routine shown in FIG. 38 is run in order to compensate for the same.

The sub-routine shown in FIG. 38 is designed to widen the adjustment range within which the air-fuel ratio can be shifted and is initiated in response the updated MSL value falling outside of the max-min range.

The first step 1701 of this routine is such as to increment a counter I which records the number of times the MSL value falls outside the acceptable range. Following this the count is compared with a predetermined number m. In the event that the count exceeds the m limit the routine is permitted to proceed to step 1703 wherein the constant K used in the equation (10) is incremented.

This increases the value of K and thus increases the smoothing function provided by the averaging process. Accordingly, the leading and trailing edges of the upstream $O_2$ sensor output are attenuated. At step 1704 the counter I is cleared and the routine ends.

FIG. 39 shows a routine which is run in the event that power source fails. When the microprocessor is found to be in its initial state after such a mishap, the value of K is rest to 1.

As a variant of the above embodiment is possible to use the output of the upstream $O_2$ sensor directly, without averaging or weighting while the min<MSL<max conditions prevail indicating that no deterioration in the upstream sensor has occurred, so as to speed up the response characteristics. Then, upon a MSL<min or MSL>max situation being sensed, it is possible to subject the output of the sensor to weighted averaging so as to widen the air-fuel ratio shift adjustment ranged (increase the air-fuel ratio sensitivity to a change of the slice level SL) and thus prevent an increase in emission levels.

FIG. 15 shows the emission characteristics achieved when K=1 in which case not weighting average is produced. Although the air-fuel ratio shift adjustment range is widened, the delay time with respect to the output of the upstream $O_2$ sensor increases when the degree to which the average is weighted, increases. For this reason it is deemed advisable to limit the degree to which the averaging can be modified.

EIGHTH EMBODIMENT

Figure 41:
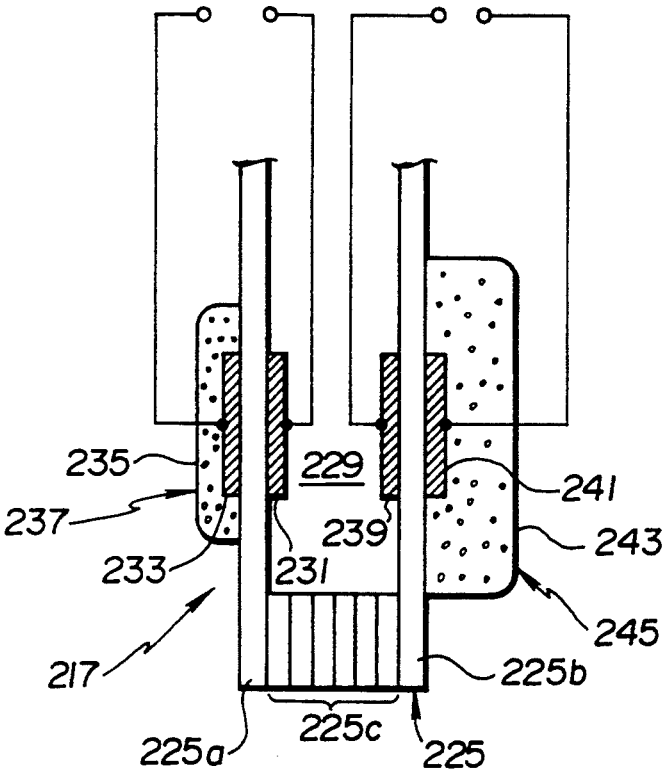
FIGS. 41 and 42 show the construction of an oxygen sensor which characterizes an eighth embodiment of the present invention.
Figure 42:
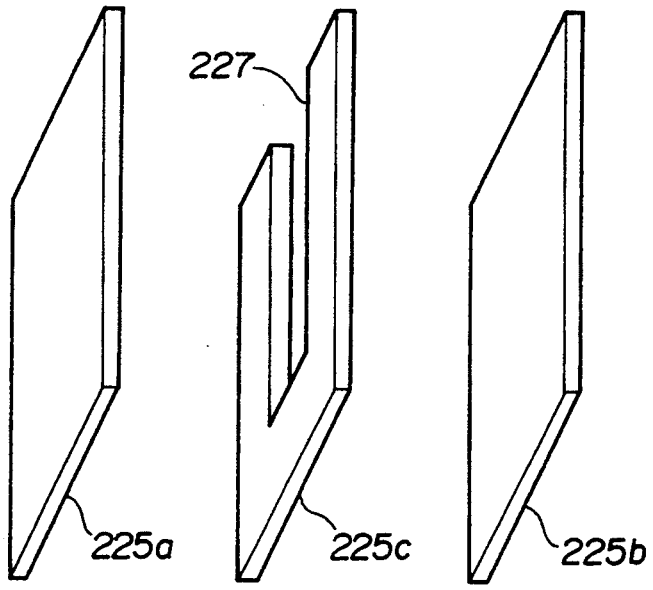
Figure 43:
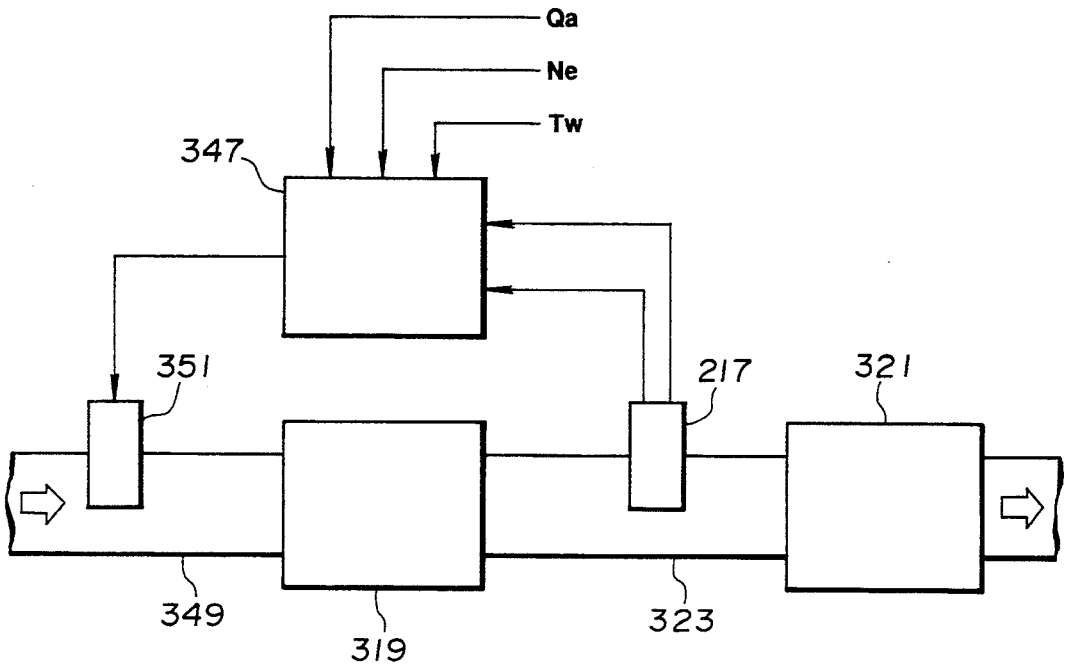
FIG. 43 is a schematic diagram showing the manner in which the oxygen sensor shown in FIGS. 41 and 42 is deployed in accordance with the eighth embodiment.

FIGS. 41 and 42 show a sensor construction which characterizes an eighth embodiment of the present invention. This sensor 217 is disposed in a relatively conventional manner as illustrated in FIG. 43. That is to say, the sensor 217 is arranged to project into an exhaust conduit 323 a location between the engine 319 and a three-way catalytic converter 321.

The sensor comprises a plurality of plates which are formed of an oxygen ion conductive electrolyte such as zirconia or titania. The plates are arranged such that a plurality of inner apertured plates **225*c* are sandwiched between two non-apertured outer plates 225*a* and 225*b*. In this arrangement the apertures 227 formed in the inner plates 225*c* define an atmospheric air chamber 229**.

A first sensor section 237 includes reference and measuring electrodes 231,233 which are formed of porous platinum. These electrodes are formed on the inner and outer faces of the outermost electrolyte plate **225*a*. A porous protective layer 235 is formed over the measuring electrode 233. A second sensor section 245 comprises reference and a measuring electrodes 239 and 241 which are formed of porous platinum on the inner and outer faces of the electrolyte plate 225*b*. A second porous protective layer 243 is formed over the surface of the second measuring electrode 241. In this embodiment the protective layer 243** also includes a catalyst.

The sensor 217 is disposed in the exhaust conduit 323 with the first sensor section being located upstream of the second one 245. The two sets of electrodes are connected with a control unit designated in FIG. 43 by the numeral 347. As schematically shown, this control unit is arranged to receive data inputs from engine load, engine speed and engine coolant temperature sensors. This unit further includes a microprocessor of the nature shown in FIG. 12.

A fuel injector 351 is arranged to controlled by the control unit 347 and to inject fuel into the induction conduit 349.

The catalyst included in the protective layer 234 is such as to damp the diffusion of the exhaust gases to an extend which is sufficient to maintain the concentration of exhaust gases in an equilibrium state. This tends to minimizes the variation in the output of the second sensor section 245.

Accordingly, it is possible to use the output of the second sensor section 245 in the same manner as the downstream $O_2$ sensors disclosed in connection with the previous embodiments. That is to say, it is possible to use the output of the second sensor section 245 to correct the feedback control constant used for feedback control of the air-fuel ratio based on the output of the first sensor section 237.

Thus, as will be appreciated with this embodiment, it is possible to obtain the same corrective advantages as the previous embodiments without the need of preparing two separate sites in the exhaust conduit.

Figure 44:
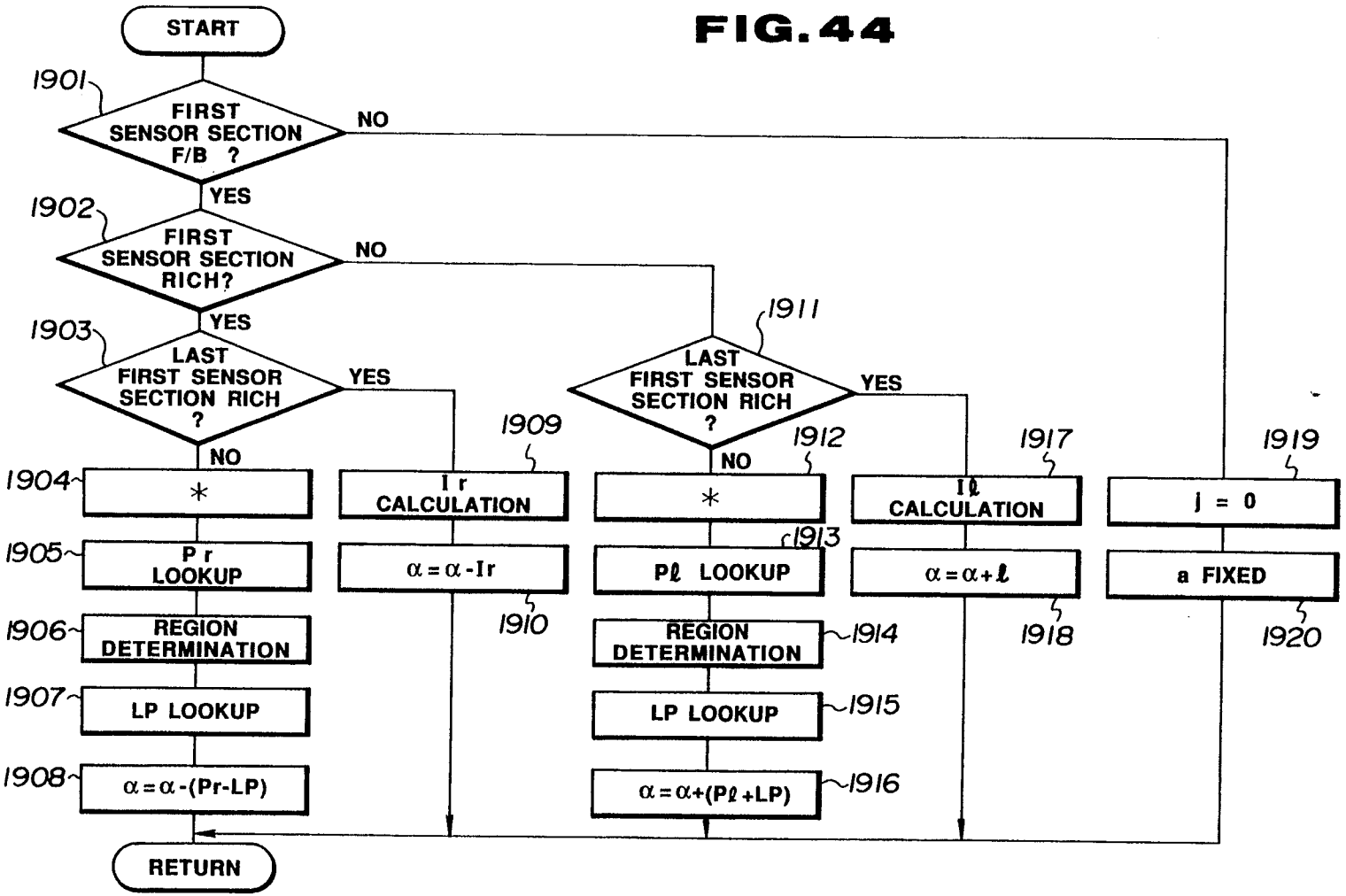
FIGS. 44 and 45 are flow charts which depict the operation of the eighth embodiment of the present invention.
Figure 45:
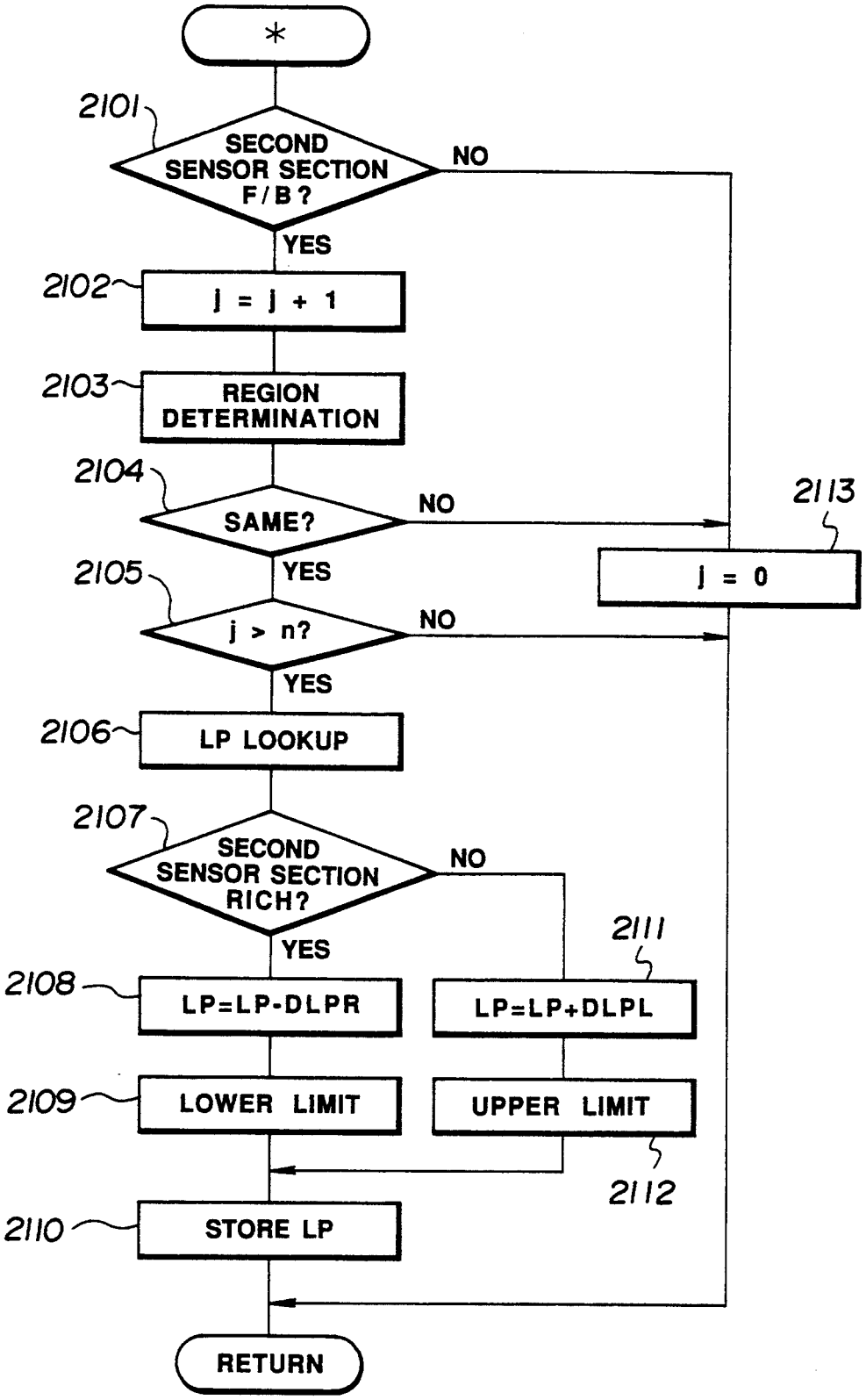

FIGS. 44 and 45 show routines which can be used in connection with the above described sensor construction. However, as will be noted, these routines are essentially the same as those of the first embodiment shown in FIGS. 15 and 16. The only noticeable difference coming in that in FIG. 44 the steps 1009, 1010 & 1016, 1017 of FIG. 15 are combined in steps 1908 and 1916. Further, redundant disclosure of the same will be omitted.

NINTH EMBODIMENT

Figure 46:
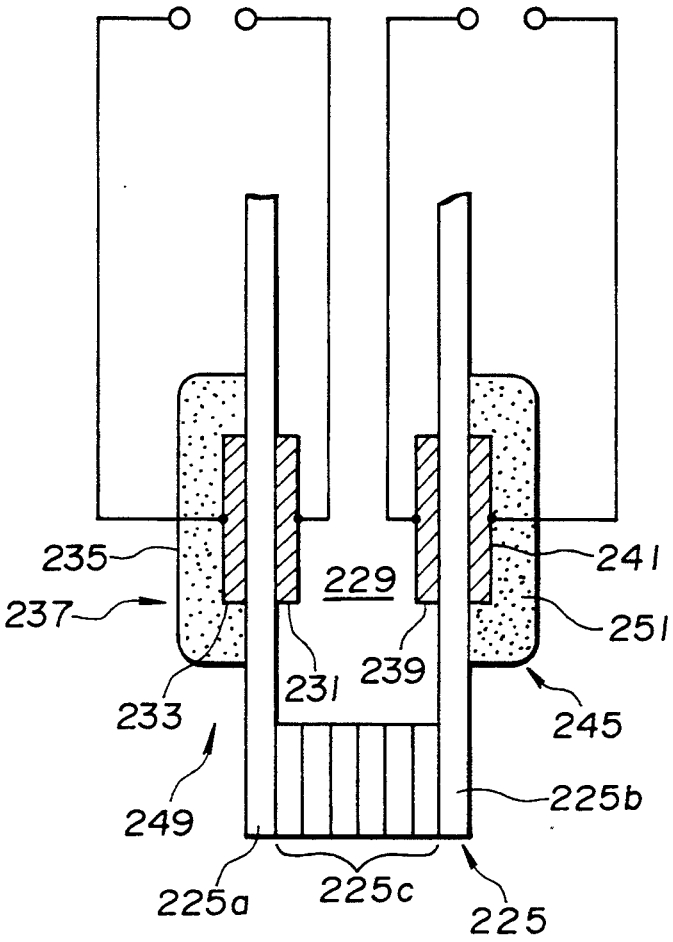
FIG. 46 is a sectioned elevation showing a variant of an oxygen sensor which can be used in accordance with the eighth embodiment of the present invention.

FIG. 46 shows a sensor construction which is essentially the same as that shown in FIG. 41 and which differs in that the measuring electrode 241 of the second downstream sensor section 245 is covered with protective layer 251 which exhibits a greater porosity than that used in the construction shown in FIG. 41. This protective layer provides an increased damping and diffusion capacity and attenuates output fluctuation.

What is claimed is:

1. A dual sensor type air-fuel ratio feedback control apparatus for an internal combustion engine, comprising:

an engine load sensor;

an engine speed sensor;

means for determining a basic fuel injection quantity based on the outputs of the engine load and speed sensors;

a first air-fuel ratio sensor disposed in an exhaust passage, at a location upstream of a catalytic converter, for producing an output indicative of the air-fuel ratio of the exhaust gases prevailing upstream of the catalytic converter;

means for averaging the output of the first air-fuel ratio sensor;

memory means, including a plurality of addresses and corresponding engine operational sub-regions, each address storing first and second slice level values;

means for determining into which of the sub-regions the current engine operation falls;

means for reading out the first slice level value which is stored at the address which corresponds to the determined sub-region;

means for comparing a working slice level value, which is based on the first slice level value which is read out, with the averaged output of the first air-fuel ratio sensor and determining if the output of the first air-fuel ratio sensor traverses the working slice level value;

means for deriving an air-fuel ratio feedback control correction factor for feedback control of the air-fuel ratio, based on a comparison of the averaged output of the first air-fuel ratio sensor and the working slice level; means for deriving a fuel injection amount by correcting the basic fuel injection quantity using the feedback control correction factor;

a second air-fuel ratio sensor disposed in the exhaust passage at a location downstream of the catalytic converter for producing an output indicative of the air-fuel ratio of the exhaust gases prevailing downstream of the catalytic converter;

means for selecting a sub-region based on a timing with which the output of the first air-fuel ratio sensor traverses the first slice level;

means for reading out the first and second slice level values stored at the address of the selected sub-region;

means for comparing the output of the second air-fuel ratio sensor with the second slice level; and means for updating the values of the first and second slice levels in accordance with the comparison of the output of the second air-fuel ratio sensor with the second slice level.

2. A dual sensor type air-fuel ratio feedback control apparatus for an internal combustion engine, comprising:

an engine load sensor;

an engine speed sensor;

means for determining a basic fuel injection quantity based on the outputs of the engine load and speed sensors;

a first air-fuel ratio sensor disposed in an exhaust passage at a location upstream of a catalytic converter for producing an output indicative of the air-fuel ratio of the exhaust gases prevailing upstream of the catalytic converter;

means for averaging the output of the first air-fuel ratio sensor;

memory means including a plurality of addresses and corresponding engine operational sub-regions, each address storing first and second slice level values;

means for determining into which of the sub-regions the current engine operation falls;

means for reading out the first slice level value which is stored at the address which corresponds to the determined sub-region;

means for comparing a working slice level value, which is based on the first slice level value which is read out, with the averaged output of the first air-fuel ratio sensor, and determining if the output of the first air-fuel ratio sensor traverses the working slice level value;

means for deriving an air-fuel ratio feedback control correction factor used for feedback control of the air-fuel ratio, based on the comparison of the averaged output of the first air-fuel ratio sensor and the working slice level;

means for deriving a fuel injection amount by correcting the basic fuel injection quantity using the feedback control correction factor;

a second air-fuel ratio sensor disposed in the exhaust passage at a location downstream of the catalytic converter for producing an output indicative of the air-fuel ratio of the exhaust gases prevailing downstream of the catalytic converter;

means for determining if the engine operation continuously falls in the same sub-region for a predetermined time following the output of the first air-fuel ratio sensor traversing the working slice level;

means for reading out the first and second slice level values stored at the address which corresponds to the sub-region selected on the basis of timing with which the first slice level is traversed by the output of the first air-fuel ratio sensor;

means for comparing the output of the second air-fuel ratio sensor with the second slice level;

means for updating the values of the first and second slice levels in accordance with the comparison of the output of second air-fuel ratio sensor with the second slice level;

means for comparing the value of the updated first slice level with maximum and minimum values;

means for indicating that the first air-fuel ratio sensor is undergoing degradation when the updated first slice level value is greater than the maximum value or less than the minimum value; and means for modifying the averaging of the output of the first air-fuel ratio sensor in accordance with the indication that the first sensor is undergoing degradation.

3. The air-fuel ratio feedback control apparatus as set forth in claim 2, wherein said first air-fuel ratio sensor is an $O_2$ sensor arranged just upstream of the catalytic converter, while said second air-fuel ratio sensor is an $O_2$ sensor arranged just downstream of the catalytic converter.

* * * * *